US010709203B2

(12) United States Patent
Granger et al.

(10) Patent No.: US 10,709,203 B2
(45) Date of Patent: Jul. 14, 2020

(54) CONTOURED SUPPORT SHOE INSOLE

(71) Applicant: Implus Footcare, LLC, Durham, NC (US)

(72) Inventors: David Bradley Granger, Lorena, TX (US); Jacob Martinez, Temple, TX (US)

(73) Assignee: IMPLUS FOOTCARE, LLC, Durham, NC (US)

( * ) Notice: Subject to any disclaimer, the term of this patent is extended or adjusted under 35 U.S.C. 154(b) by 145 days.

(21) Appl. No.: 15/575,445

(22) PCT Filed: May 27, 2016

(86) PCT No.: PCT/US2016/034578
§ 371 (c)(1),
(2) Date: Nov. 20, 2017

(87) PCT Pub. No.: WO2016/191654
PCT Pub. Date: Dec. 1, 2016

(65) Prior Publication Data

US 2018/0192739 A1 Jul. 12, 2018

Related U.S. Application Data

(60) Provisional application No. 62/167,843, filed on May 28, 2015, provisional application No. 62/182,302, filed on Jun. 19, 2015.

(51) Int. Cl.
*A43B 13/38* (2006.01)
*A43B 17/18* (2006.01)
(Continued)

(52) U.S. Cl.
CPC ..... *A43B 17/18* (2013.01); *A43B 7/142* (2013.01); *A43B 7/143* (2013.01); *A43B 7/144* (2013.01);
(Continued)

(58) Field of Classification Search
CPC ..... A43B 7/14–149; A43B 17/06–17
See application file for complete search history.

(56) References Cited

U.S. PATENT DOCUMENTS 333,595 A 1/1886 Butterfield
360,127 A 3/1887 Wallis
(Continued)

FOREIGN PATENT DOCUMENTS

DE 2603716 12/1976
EP 0774219 12/1997
(Continued)

OTHER PUBLICATIONS

[Online] [retrieved on Jan. 22, 2013] [retrieved from Foot Science Limited website] (pdf) http://www.footscience.com/products_foot.html.

(Continued)

*Primary Examiner* — Jila M Mohandesi
(74) *Attorney, Agent, or Firm* — Buchanan, Ingersoll & Rooney PC

(57) ABSTRACT

An insole having a top sheet, a base layer, a forefoot pad, a heel cushion, and stability cradle. The forefoot pad can be made a blown EVA or other material, and the heel cushion can be made of a clear TPR, soft polyurethane or blown EVA. A heel cup surrounds the exterior back by a heel cup, and a heel pod opening and midfoot pod opening is located in the stability cradle for allowing placement of heel pads and midfoot pads in a replacement manner. There is also a soft metatarsal raised dome on the top (foot contact) surface of the insole which would be directly above the metatarsal midfoot area.

46 Claims, 9 Drawing Sheets

(51) Int. Cl.

| | |
|---|---|
| ***A43B 7/14*** | (2006.01) |
| ***A43B 13/22*** | (2006.01) |
| ***A43B 17/00*** | (2006.01) |
| ***A43B 17/02*** | (2006.01) |
| ***A43B 17/08*** | (2006.01) |
| ***A43B 17/14*** | (2006.01) |

(52) U.S. Cl.

CPC ..... *A43B 7/145* (2013.01); *A43B 7/148* (2013.01); *A43B 7/149* (2013.01); *A43B 7/1425* (2013.01); *A43B 7/1435* (2013.01); *A43B 7/1445* (2013.01); *A43B 7/1455* (2013.01); *A43B 7/1465* (2013.01); *A43B 7/1475* (2013.01); *A43B 7/1485* (2013.01); *A43B 13/223* (2013.01); *A43B 17/006* (2013.01); *A43B 17/026* (2013.01); *A43B 17/08* (2013.01); *A43B 17/14* (2013.01)

(56) References Cited

U.S. PATENT DOCUMENTS

| | | | |
|---|---|---|---|
| 892,360 | A | 6/1908 | Burns |
| 1,559,324 | A | 10/1925 | Jensen |
| 1,688,642 | A | 10/1928 | Mattison |
| 1,693,122 | A | 11/1928 | Schwartz |
| 1,718,906 | A | 6/1929 | Hurley |
| 1,811,641 | A | 6/1931 | Marcelle |
| 1,861,969 | A | 6/1932 | Leighton, Jr. |
| 1,920,112 | A | 7/1933 | Shaft |
| 1,945,780 | A | 2/1934 | Johnson |
| 2,031,510 | A | 2/1936 | Stewart et al. |
| 2,045,844 | A | 6/1936 | Everston |
| 2,055,574 | A | 9/1936 | Hartl |
| 2,090,881 | A | 8/1937 | Wilson |
| 2,207,437 | A | 7/1940 | Marks et al. |
| 2,224,590 | A | 12/1940 | Boivin |
| 2,224,642 | A | 12/1940 | Burns |
| 2,284,947 | A | 6/1942 | Clifford |
| 2,302,706 | A | 11/1942 | Margolin |
| 2,347,207 | A | 4/1944 | Margolin |
| 2,408,564 | A | 10/1946 | Lea |
| D149,889 | S | 6/1948 | Laybolt |
| 2,502,774 | A | 4/1950 | Alianiello |
| 2,553,616 | A | 5/1951 | Walls |
| 2,790,254 | A | 4/1957 | Burns |
| 2,827,050 | A | 3/1958 | Fisher |
| 2,857,689 | A | 10/1958 | Van Ostrom et al. |
| 2,985,971 | A | 5/1961 | Murawski |
| 3,084,695 | A | 4/1963 | O'Donnell |
| 3,154,867 | A | 11/1964 | Strope |
| 3,475,836 | A | 11/1969 | Brahm |
| 3,992,801 | A | 11/1976 | McDiarmid et al. |
| D243,642 | S | 3/1977 | Voorhees |
| 4,020,570 | A | 5/1977 | Shames |
| 4,033,054 | A | 7/1977 | Fukuoka |
| D246,486 | S | 11/1977 | Nickel |
| 4,071,963 | A | 2/1978 | Fukuoka |
| 4,108,928 | A | 8/1978 | Swan, Jr. |
| 4,123,855 | A | 11/1978 | Thedford |
| 4,139,337 | A | 2/1979 | David et al. |
| 4,150,455 | A | 4/1979 | Fukuoka |
| 4,179,826 | A | 12/1979 | Davidson |
| 4,215,492 | A | 8/1980 | Sandmeier |
| 4,219,945 | A | 9/1980 | Rudy |
| 4,223,457 | A | 9/1980 | Borgeas |
| 4,229,546 | A | 10/1980 | Swan, Jr. |
| 4,237,626 | A | 12/1980 | Brown |
| 4,263,728 | A | 4/1981 | Frecentese |
| 4,309,831 | A | 1/1982 | Pritt |
| 4,316,332 | A | 2/1982 | Giese et al. |
| 4,325,380 | A | 4/1982 | Malkin |
| 4,346,205 | A | 8/1982 | Hiles |
| 4,346,525 | A | 8/1982 | Larsen et al. |
| 4,364,188 | A | 12/1982 | Turner et al. |
| 4,408,402 | A | 10/1983 | Looney |
| 4,413,429 | A | 11/1983 | Power |
| 4,453,322 | A | 6/1984 | Marsh |
| 4,541,184 | A | 9/1985 | Leighton |
| 4,541,186 | A | 9/1985 | Mulvihill |
| 4,546,555 | A | 10/1985 | Spademan |
| 4,557,060 | A | 12/1985 | Kawashima |
| 4,571,857 | A | 2/1986 | Castellanos |
| 4,581,187 | A | 4/1986 | Sullivan et al. |
| 4,584,782 | A | 4/1986 | Thatcher |
| 4,616,430 | A | 10/1986 | McQuiggin |
| 4,619,056 | A | 10/1986 | Lin et al. |
| 4,627,178 | A | 12/1986 | Sullivan et al. |
| 4,627,179 | A | 12/1986 | McElroy |
| 4,633,597 | A | 1/1987 | Shiang |
| 4,633,598 | A | 1/1987 | Moronaga et al. |
| 4,633,877 | A | 1/1987 | Pendergast |
| D288,383 | S | 2/1987 | Autry |
| 4,674,204 | A | 6/1987 | Sullivan et al. |
| 4,694,589 | A | 9/1987 | Sullivan et al. |
| 4,694,831 | A | 9/1987 | Seltzer |
| 4,729,179 | A | 3/1988 | Quist, Jr. |
| D295,690 | S | 5/1988 | Finn |
| D299,583 | S | 1/1989 | Tong et al. |
| 4,800,657 | A | 1/1989 | Brown |
| 4,808,469 | A | 2/1989 | Hiles |
| 4,813,160 | A | 3/1989 | Kuznetz |
| 4,860,463 | A | 8/1989 | Pin |
| 4,864,736 | A | 9/1989 | Bierk |
| 4,864,740 | A | 9/1989 | Oakley |
| 4,876,758 | A | 10/1989 | Rolloff et al. |
| 4,887,368 | A | 12/1989 | Latzke |
| 4,888,841 | A | 12/1989 | Cumberland |
| 4,888,887 | A | 12/1989 | Solow |
| 4,928,404 | A | 5/1990 | Scheuermann |
| D311,269 | S | 10/1990 | Graham et al. |
| 4,974,342 | A | 12/1990 | Nakamura |
| 5,010,661 | A | 4/1991 | Chu |
| 5,014,706 | A | 5/1991 | Philipp |
| 5,025,573 | A | 6/1991 | Giese et al. |
| 5,025,575 | A | 6/1991 | Lakic |
| 5,027,461 | A | 7/1991 | Cumberland |
| 5,035,068 | A | 7/1991 | Biasi |
| D319,919 | S | 9/1991 | Niarhos |
| D324,761 | S | 3/1992 | Soo-Kwan |
| 5,092,060 | A | 3/1992 | Frachey et al. |
| 5,138,775 | A | 4/1992 | Chu |
| 5,155,927 | A | 10/1992 | Bates et al. |
| 5,175,946 | A | 1/1993 | Tsai |
| 5,184,409 | A | 2/1993 | Brown |
| 5,197,207 | A | 3/1993 | Shorten |
| 5,201,125 | A | 4/1993 | Shorten |
| D336,718 | S | 6/1993 | Schroer, Jr. |
| 5,224,277 | A | 7/1993 | Sang Do |
| 5,233,767 | A | 8/1993 | Kramer |
| D342,374 | S | 12/1993 | Wang |
| 5,282,324 | A | 2/1994 | Cheng |
| D346,480 | S | 5/1994 | Davidson |
| D348,146 | S | 6/1994 | Nakano |
| D349,393 | S | 8/1994 | Mishan |
| D350,432 | S | 9/1994 | Saez |
| D350,848 | S | 9/1994 | Tzenos |
| 5,363,570 | A | 11/1994 | Allen et al. |
| 5,367,791 | A | 11/1994 | Gross et al. |
| D353,710 | S | 12/1994 | Brazzell |
| 5,369,896 | A | 12/1994 | Frachey et al. |
| 5,375,346 | A | 12/1994 | Cole et al. |
| 5,400,528 | A | 3/1995 | Skinner et al. |
| 5,400,526 | A | 4/1995 | Sessa |
| 5,408,761 | A | 4/1995 | Gazzano |
| 5,430,960 | A | 7/1995 | Richardson |
| 5,438,768 | A | 8/1995 | Bauerfeind |
| 5,443,529 | A | 8/1995 | Phillips |
| 5,467,536 | A | 11/1995 | Ramer et al. |
| 5,493,791 | A | 2/1996 | Kramer |
| D367,953 | S | 3/1996 | King |
| 5,509,938 | A | 4/1996 | Phillips |
| 5,524,364 | A | 6/1996 | Cole et al. |
| 5,545,463 | A | 8/1996 | Schmidt et al. |

(56) References Cited

U.S. PATENT DOCUMENTS

D374,549 S 10/1996 McDonald
5,615,496 A 4/1997 Sharpstein
5,619,809 A 4/1997 Sessa
5,640,779 A 6/1997 Rolloff et al.
D380,290 S 7/1997 Nakagawa
D383,894 S 9/1997 Snyder et al.
5,669,162 A 9/1997 Dyer
D384,797 S 10/1997 Nakagawa
5,675,914 A 10/1997 Cintron
5,678,328 A 10/1997 Schmidt et al.
5,685,094 A 11/1997 Lin
D388,947 S 1/1998 Sessa
D389,296 S 1/1998 Sessa
D389,996 S 2/1998 Sessa
5,714,098 A 2/1998 Potter
5,722,186 A 3/1998 Brown
5,732,481 A 3/1998 Farhad
5,768,801 A 6/1998 Huff
5,771,606 A 6/1998 Litchfield et al.
5,775,005 A 7/1998 McClelland
D396,948 S 8/1998 Moore et al.
5,802,737 A 9/1998 Beppu
D399,042 S 10/1998 Strawser et al.
5,815,949 A 10/1998 Sessa
5,845,418 A 12/1998 Chi
5,846,063 A 12/1998 Lakic
5,852,885 A 12/1998 Ferniani
D403,847 S 1/1999 Blythe
5,879,725 A 3/1999 Potter
D411,759 S 7/1999 Byrd
D418,666 S 1/2000 Brown
D420,210 S 2/2000 Allen
D420,788 S 2/2000 Kitagawa
6,029,372 A 2/2000 Pan
D423,765 S 5/2000 Autry
D425,690 S 5/2000 Bray et al.
D426,118 S 6/2000 Thomas
6,070,342 A 6/2000 Brown
6,079,123 A 6/2000 Clark
6,082,023 A 7/2000 Dalton
D428,689 S 8/2000 Guiotto et al.
D429,063 S 8/2000 Rose
6,105,283 A 8/2000 Park
D432,769 S 10/2000 Yung et al.
6,151,801 A 11/2000 Frederiksen et al.
6,176,025 B1 1/2001 Patterson et al.
D441,947 S 5/2001 Escobar et al.
6,233,847 B1 5/2001 Brown
6,266,897 B1 7/2001 Seydel et al.
D448,542 S 10/2001 Bryant
D448,850 S 10/2001 Fabricant
6,301,805 B1 10/2001 Howlett et al.
D456,128 S 4/2002 Evans et al.
D460,854 S 7/2002 Hung
6,425,195 B1 7/2002 Donzis
6,453,578 B1 9/2002 Yung et al.
D465,079 S 11/2002 Merceron
6,481,120 B1 11/2002 Xia et al.
6,497,057 B1 12/2002 Lee et al.
6,502,330 B1 1/2003 David et al.
6,510,626 B1 * 1/2003 Greenawalt ..... A43B 7/142 36/160
6,519,874 B1 2/2003 Dean
D471,001 S 3/2003 Beck
6,536,137 B1 3/2003 Celia
6,553,690 B2 4/2003 Di Girolamo
D474,331 S 5/2003 Dean
D474,588 S 5/2003 Dean
D474,881 S 5/2003 Su
D475,844 S 6/2003 Reynolds et al.
6,581,303 B1 6/2003 Tuan
6,598,319 B2 7/2003 Hardt
6,618,960 B2 9/2003 Brown
6,631,568 B2 10/2003 Howlett et al.
D485,425 S 1/2004 Polifroni
D485,426 S 1/2004 Di Girolamo
6,671,979 B2 1/2004 Cardarelli
6,684,532 B2 2/2004 Greene et al.
D489,520 S 5/2004 Matis et al.
D495,123 S 8/2004 Wakatake
D497,473 S 10/2004 Martinez
D497,708 S 11/2004 Granger et al.
6,817,115 B2 11/2004 Polifioni
D500,914 S 1/2005 Ammon
6,880,266 B2 4/2005 Schoenborn et al.
6,915,598 B2 7/2005 Grisoni et al.
6,959,505 B2 11/2005 Poe
6,967,044 B1 11/2005 O'Brien
D515,292 S 2/2006 Granger et al.
7,082,702 B2 8/2006 Cretinon
7,082,704 B2 8/2006 Throneburg
7,107,705 B2 9/2006 Dalton et al.
D529,691 S 10/2006 Earle
D543,685 S 6/2007 Andersen et al.
7,284,342 B2 10/2007 Avent et al.
7,316,081 B1 1/2008 Cheng
D563,649 S 3/2008 Andersen et al.
D576,391 S 9/2008 Contreras
D576,394 S 9/2008 Heller
7,437,836 B2 10/2008 Kim
D584,885 S 1/2009 Contreras
7,484,319 B2 * 2/2009 Cheskin ..... A43B 7/141 36/144
D592,386 S 5/2009 Baker et al.
D593,742 S 6/2009 Issler
D594,640 S 6/2009 McMillan
D596,833 S 7/2009 Dominguez et al.
7,555,849 B2 7/2009 Canvin
D602,238 S 10/2009 Avent et al.
7,610,696 B2 11/2009 Davis
7,665,169 B2 2/2010 Cheskin et al.
D611,237 S 3/2010 Torrance et al.
7,712,229 B2 5/2010 Yang
7,721,467 B2 5/2010 Cheskin et al.
D617,086 S 6/2010 Avent et al.
D617,087 S 6/2010 Avent et al.
D627,958 S 11/2010 Cheskin et al.
D628,779 S 12/2010 Martinez et al.
D634,920 S 3/2011 Martinez et al.
D634,924 S 3/2011 Cheskin et al.
7,900,380 B2 3/2011 Rich
7,908,768 B2 * 3/2011 Cheskin ..... A43B 7/141 36/144
8,136,266 B2 3/2012 McCarron
D656,716 S 4/2012 Eades
8,186,081 B2 5/2012 Wilson, III et al.
D663,511 S 7/2012 Martinez et al.
8,241,450 B2 8/2012 Hensley et al.
8,250,783 B2 * 8/2012 Luthi ..... A43B 7/142 36/155
8,250,784 B2 8/2012 Cheskin et al.
8,296,969 B2 10/2012 Granger et al.
8,424,222 B2 4/2013 Sulak et al.
D681,321 S 5/2013 Martinez et al.
8,745,894 B2 6/2014 Cheskin et al.
D723,786 S 3/2015 Martinez et al.
2001/0000369 A1 4/2001 Snyder et al.
2001/0045028 A1 11/2001 Crane et al.
2002/0050080 A1 5/2002 Vasyli
2002/0092203 A1 7/2002 Hardt
2002/0116840 A1 8/2002 Kraft
2003/0009915 A1 1/2003 Bacon
2003/0024134 A1 2/2003 Howlett et al.
2003/0070321 A1 4/2003 Davis et al.
2003/0093920 A1 * 5/2003 Greene ..... A43B 7/141 36/25 R
2003/0121180 A1 7/2003 Poe
2003/0136025 A1 7/2003 Galbraith et al.
2003/0150134 A1 8/2003 Hardt
2004/0020075 A1 2/2004 Garneau
2004/0025374 A1 2/2004 Basso
2004/0118017 A1 * 6/2004 Dalton ..... A43B 7/142 36/44
2004/0181971 A1 9/2004 Turkbas et al.

(56) References Cited

U.S. PATENT DOCUMENTS

| | | | | |
|---|---|---|---|---|
| 2004/0194344 | A1* | 10/2004 | Tadin | A43B 7/141 36/44 |
| 2005/0138847 | A1 | 6/2005 | Blackburn et al. | |
| 2005/0166425 | A1 | 8/2005 | Seiter | |
| 2005/0262736 | A1 | 12/2005 | Peoples | |
| 2006/0010717 | A1 | 1/2006 | Finkelstein | |
| 2006/0016099 | A1 | 1/2006 | Marco et al. | |
| 2006/0026779 | A1 | 2/2006 | Berg et al. | |
| 2006/0026865 | A1 | 2/2006 | Grisoni et al. | |
| 2006/0096124 | A1 | 5/2006 | Moseley | |
| 2006/0123664 | A1 | 6/2006 | Boyd et al. | |
| 2006/0130367 | A1 | 6/2006 | Liu | |
| 2006/0137216 | A1 | 6/2006 | Ahlbaumer | |
| 2006/0168846 | A1 | 8/2006 | Juan | |
| 2006/0230643 | A1 | 10/2006 | Affleck | |
| 2006/0254088 | A1 | 10/2006 | McCormick | |
| 2006/0283043 | A1 | 12/2006 | Lamstein | |
| 2007/0022630 | A1 | 2/2007 | Lundy, Jr. et al. | |
| 2007/0033834 | A1 | 2/2007 | Cheskin et al. | |
| 2007/0039209 | A1 | 2/2007 | White | |
| 2007/0084084 | A1 | 4/2007 | Rich | |
| 2007/0245592 | A1 | 10/2007 | Yamaguchi et al. | |
| 2007/0261268 | A1 | 11/2007 | Nguyen | |
| 2008/0028637 | A1 | 2/2008 | Benfatti | |
| 2008/0110060 | A1 | 5/2008 | Ritter | |
| 2008/0110064 | A1 | 5/2008 | Liu | |
| 2008/0271340 | A1 | 11/2008 | Grisoni et al. | |
| 2008/0295358 | A1 | 12/2008 | Lin et al. | |
| 2009/0025254 | A1 | 1/2009 | Smith | |
| 2009/0049712 | A1 | 2/2009 | Steszyn et al. | |
| 2009/0100722 | A1 | 4/2009 | Hoffer et al. | |
| 2009/0151194 | A1 | 6/2009 | Cheskin et al. | |
| 2009/0165334 | A1 | 7/2009 | Kantro et al. | |
| 2009/0249650 | A1 | 10/2009 | Sarantakos | |
| 2010/0015869 | A1 | 1/2010 | Hartmann et al. | |
| 2010/0083534 | A1 | 4/2010 | Howlett | |
| 2010/0095552 | A1 | 4/2010 | Cheskin et al. | |
| 2010/0126044 | A1 | 5/2010 | Davis | |
| 2010/0170116 | A1 | 7/2010 | Shim | |
| 2010/0205831 | A1 | 8/2010 | Cheskin et al. | |
| 2010/0212187 | A1 | 8/2010 | Jones | |
| 2010/0218398 | A1 | 9/2010 | Reinhardt et al. | |
| 2010/0218399 | A1 | 9/2010 | Jeong | |
| 2010/0251577 | A1 | 10/2010 | Yamada | |
| 2010/0269371 | A1 | 10/2010 | Gray | |
| 2011/0041360 | A1 | 2/2011 | Torrance | |
| 2011/0072685 | A1 | 3/2011 | Gutowsky, Jr. et al. | |
| 2011/0131835 | A1 | 6/2011 | Cheskin | |
| 2011/0162234 | A1 | 7/2011 | Dean | |
| 2011/0209360 | A1 | 9/2011 | Baker et al. | |
| 2011/0219642 | A1 | 9/2011 | Sulak et al. | |
| 2011/0232129 | A1 | 9/2011 | Roberts et al. | |
| 2011/0252665 | A1 | 10/2011 | Tsai | |
| 2011/0252671 | A1 | 10/2011 | Maron et al. | |
| 2011/0302805 | A1 | 12/2011 | Vito | |
| 2012/0023776 | A1 | 2/2012 | Skaja | |
| 2012/0079747 | A1* | 4/2012 | Seo | A43B 13/127 36/25 R |
| 2012/0090197 | A1 | 4/2012 | Wyner et al. | |
| 2012/0192452 | A1 | 8/2012 | Lewis et al. | |
| 2012/0272546 | A1 | 11/2012 | Tsai | |
| 2013/0008050 | A1 | 1/2013 | Marc | |
| 2013/0104419 | A1 | 5/2013 | Horesh et al. | |
| 2013/0160331 | A1 | 6/2013 | Burke | |

FOREIGN PATENT DOCUMENTS

| | | |
|---|---|---|
| KR | 20-19930024801 | 5/1992 |
| KR | 20-0312671 | 5/2003 |
| KR | 20-0427687 | 4/2006 |
| KR | 10-0641278 | 10/2006 |
| KR | 10-0736813 | 7/2007 |
| KR | 10-0780086 | 11/2007 |
| KR | 10-20090059886 | 6/2009 |
| KR | 10-0960562 | 6/2010 |
| KR | 10-1006923 | 1/2011 |
| KR | 10-1314656 | 10/2013 |
| KR | 10-1472734 | 12/2014 |
| WO | WO 2004060095 | 7/2004 |
| WO | WO 2006035469 | 4/2006 |
| WO | WO 2006090398 | 8/2006 |
| WO | WO 2007021328 | 2/2007 |
| WO | WO 2007056101 | 5/2007 |
| WO | 200815195 | 12/2008 |
| WO | WO 2009068298 | 6/2009 |
| WO | WO 2009126111 | 10/2009 |
| WO | WO 2009136685 | 11/2009 |
| WO | WO 2010124631 | 4/2010 |
| WO | WO 2011108011 | 9/2011 |
| WO | WO 2014036176 | 3/2014 |
| WO | WO 2014201423 | 12/2014 |
| WO | WO 2015038737 | 3/2015 |

OTHER PUBLICATIONS

[Online] [retrieved on Jan. 22 ,2013] [retrieved from geldoctor website] (pdf) http://www.geldoctor.com/flosole.html.

[Online] [retrieved on Jan. 22, 2013] [retrieved from Gerbing's website] (pdf) http://www.gerbing.com/Products/insoles.php.

[Online] [retrieved on Janaury 22, 2013] [retrieved from Heat Factory website] (pdf) http://www.heatfactory.com/english/product.pht?cat=3&id.

[Online] [retrieved on Jan. 22, 2013] [retrieved from Dr. Rosenberg's Foot Products website] (pdf) http://www.instantarches.com/cool-soles.shtml.

[Online] [retrieved on Jan. 22, 2013] [retrieved from Mean and Green website]web page] (pdf) http://www.meanandgreen.com/army/-Thermal-Foil_insoles/2660/2303.html.

[Online] [retrieved on Jan. 22, 2013] [retrieved from Superfeet website] (pef) http://www.superfeet.com/products/REDHot.aspx.

[Online] [retrieved on Jan. 22, 2013] [retrieved from Thermo Soles website] (pdf) http://www.thermosoles.com/.

[Online] [retrieved on Jan. 22, 2014] [retreived from Warmers.com website] (pdf) http://www.warmers.com/grabber-got-warmers-medium-5-hour-10pr-bundle.

PCT, International Search Report & Written Opinion of the International Searching Authority for PCT/US2013/026932, dated Jun. 18, 2013.

PCT, International Search Report & Written Opinion of the International Searching Authority for Counterpart International Patent Application No. PCT/US2006/014681, dated Jul. 27, 2006.

PCT, International Search Report & Written Opinon of the International Searching Authority for Counterpart International Pataent Application No. PCT/US2013/057141, dated Nov. 12, 2013.

PCT, International Search Report & Written Opinon of the International Searching Authority for Counterpart International Patent Application No. PCT/US2014/0055133, dated Jan. 15, 2015.

PCT, International Search Report and Written Opinon of the International Searching Authority for Counterpart International Patent Application No. PCT/US2006/042885, dated Mar. 13, 2007.

Supplementary Extended European Search Report of the European Patent Office for European Search Report No. EP 13754536.4, dated Jun. 1, 2015.

PCT, International Search Report & Written Opinon of the International Searching Authority for Counterpart International Patent Application No. PCT/US2015/011960, dated Apr. 30, 2015.

The extended European Search Report dated Dec. 21, 2018, by the European Patent Office in corresponding European Patent Application No. 16800780.5-1011. (9 pages).

PCT, International Search Report & Written Opinion of the International Searching Authority for International Patent Application No. PCT/US2016/034578, dated Sep. 19, 2016.

* cited by examiner

CONTOURED SUPPORT SHOE INSOLE

CROSS REFERENCE TO RELATED APPLICATIONS

This application claims the benefit of U.S. Provisional Patent Application Ser. No. 62/167,843 filed May 28, 2015 and U.S. Provisional Patent Application Ser. No. 62/182,302 filed Jun. 19, 2015.

STATEMENT REGARDING FEDERALLY SPONSORED RESEARCH OR DEVELOPMENT

Not applicable.

TECHNICAL FIELD

The present invention relates in general to an improved shoe insole and more particularly to an insole providing improved cushioning and support to the foot of a wearer.

BACKGROUND OF THE INVENTION

Insoles are inserted in the shoes of a user to provide one or more advantages to the comfort of the wearer or the support of the foot. Insoles are generally sold in pairs and one of each pair is adapted for use in a right shoe and the other adapted for use in a left shoe of a user. It is advantageous to provide appropriate structure to an insole so that it serves the purposes of the user.

The human foot is a very complex biological mechanism. The load on the foot at heel strike is typically about one and a half times a person's body weight when a person walks. When running or carrying extra weight, such as a backpack, loads on the foot can exceed three times the body weight. The many bones, muscles, ligaments, and tendons of the foot function to absorb and dissipate the forces of impact, carry the weight of the body and other loads, and provide forces for propulsion. Properly designed shoe insoles can assist the foot in performing these functions and protect the foot from injury.

Insoles may be custom made to address the specific needs of an individual. They may be made based on casts of the end user's foot or may be made of a thermoplastic material that is molded to the contours of the end user's foot. Like most custom made items, custom insoles tend to be expensive because of the low volume and extensive time needed to make and fit them properly. As such, it is not practical to make such custom made insoles for the general public.

To be practical for distribution to the general public, an insole must be able to provide benefit to the user without requiring individualized adjustment and fitting. A first type of insole commonly available over-the-counter emphasizes cushioning the foot so as to maximize shock absorption. For typical individuals cushioning insoles perform adequately while engaged in light to moderate activities, such as walking or running. That is, a cushioning insole provides sufficient cushioning and support for such activities. However, for more strenuous or technically challenging activities, such as carrying a heavy backpack or traversing difficult terrain, a typical cushioning insole will not be adequate. Under such conditions, a cushioning insole by itself would not provide enough support and control, and tends to bottom out during use by fully compressing the cushioning insole.

Another type of over-the-counter insole emphasizes control. Typically, such insoles are made to be relatively stiff and rigid so as to control the bending and twisting of the foot by limiting foot motion. The rigid structure is good at controlling motion, but is not very forgiving. As a result, when motion of the foot reaches a limit imposed by the rigid structure, the load on the foot tends to change abruptly and increases the load on the structures of the foot. Because biological tissues such as tendons and ligaments are sensitive to the rate at which they are loaded, the abrupt change in load causes injury or damage to the foot, ankle or leg.

In view of the foregoing, it would be desirable to provide an over-the-counter insole that provides both cushioning and control. It would also be desirable to provide an insole that provides both cushioning and control and is practical for use by the general public during cross-training or triathlon-related activities.

The Applicant has received patents for insoles having a support cushion and multiple pods located thereon. These patents include U.S. Pat. Nos. 7,484,319; 7,665,169; 7,908,768; and, 8,250,784. These prior art patents, however, do not address the problems of enhanced cushioning and stability, possible movement of the insole during shoe operation, or establishing enhanced cushioning characteristics to address running and walking usages.

There is a need for insoles to be easier to construct and made of materials that can provide: (1) provide increased ankle and foot stability, (2) cushion the heel and forefoot during push-offs and landings, (3) custom-contour to the inside shape of all types of shoes, (4) be extremely light, (5) provide enhanced cushioning capabilities and (6) have essentially zero movement or sliding.

Insoles may be custom made to address the specific needs of an individual. They may be made based on casts of the end user's foot or may be made of a thermoplastic material that is molded to the contours of the end user's foot. However, it is not practical to make such insoles for the general public. Like most custom made items, custom insoles tend to be expensive because of the low volume and extensive time needed to make and fit them properly.

To be practical for distribution to the general public, an insole must be able to provide benefit to the user without requiring individualized adjustment and fitting. A first type of insole commonly available over-the-counter emphasizes cushioning the foot so as to maximize shock absorption. For typical individuals cushioning insoles perform adequately while engaged in light to moderate activities such as walking or running. That is, a cushioning insole provides sufficient cushioning and support for such activities. However, for more strenuous or technically challenging activities, such as carrying a heavy backpack or traversing difficult terrain, a typical cushioning insole may not be adequate. Under such conditions, a cushioning insole by itself would not provide enough support and control, and may tend to bottom out during use.

Another type of over-the-counter insole emphasizes control. Typically, such insoles are made to be relatively stiff and rigid so as to control the bending and twisting of the foot by limiting foot motion. The rigid structure is good at controlling motion, but is not very forgiving. As a result, when motion of the foot reaches a limit imposed by the rigid structure, the load on the foot tends to change abruptly and may increase the load on the structures of the foot. Because biological tissues such as tendons and ligaments are sensitive to the rate at which they are loaded, the abrupt change in load may cause injury or damage.

In view of the foregoing, it would be desirable to provide an over-the-counter insole that provides both cushioning and control. It would also be desirable to provide an insole that provides both cushioning and control and is practical for use by the general public. And, it would be desirable to provide an insole that can be modified or adjusted by the user without the need to acquire different insoles.

SUMMARY OF THE INVENTION

It is an object of the present invention to provide an insole that provides improved cushioning, support, and control and is practical for use by the general public. The above, and other objects and advantages of the present invention are provided by an insole that provides improved motion control, support and cushioning. The insole includes a system of interacting components that cooperate to achieve a desired combination of foot cushioning, support and motion control. The components include a foam core, a semi-rigid stability cradle, and a number of elastomeric pods and pads. The characteristics of the components, their size and shape, and their position are selected to provide a desired blend of cushioning and control, and more specifically to achieve a desired biomechanical function.

In accordance with principles of the present invention, a cushioning core or base is combined with a relatively stiff stability cradle and a number of elastomeric pods to form an insole that provides cushioning, stability, and control. By altering the size, shape, and material properties of the pods insoles may be designed to address issues of over/under pronation, over/under supination, and other problems related to foot motion.

In a preferred embodiment of the present invention, the components of an insole are permanently affixed to each other to create an insole designed for an intended type or category of activity. Many insole designs may then be made available to address a broad range of different activities. In an alternative embodiment of the invention, an insole may comprise a kit including a number of interchangeable pods having different characteristics. Using such a kit, an end user may selectively change the pods to customize the insole to accommodate a specific activities of the user.

The present invention is an insole having a top sheet, a toe pad with sizing stripes, a base layer with a stability cradle indentation and a forefoot pad indentation, forefoot pad with diagonally-aligned ridges, a stability cradle with a heel pod opening, a midfoot pod opening, a first set of elongated, transverse ribs in a raised medial arch, a second set of vertical support ribs surrounding a heel cup, and a third set of vertical support ribs aligned in a lateral midfoot area. The heel pod opening is configured to have two or more heel adjacent, contiguous pads (medial heel pad and lateral heel pad) removably attached to the stability cradle in the heel pod opening, and the midfoot pod opening is configured to have at least one midfoot pad removably attached to the stability cradle in the midfoot pod opening.

The lateral or medial heel pad is located on the bottom surface of the insole. The medial or lateral heel pad, or the midfoot pad, on the bottom surface of the insole can be made of clear TPR (thermoplastic rubber) or pre-blown ethylene vinyl acetate (EVA), molded of EVA, polyurethane (PU), or other suitable material with a hardness of approximately 10-35 Asker C±3, a thickness of approximately 3.0 mm±0.5 mm, or alternatively, integrally formed in the material of the base bottom surface of the insole. The thickness of the medial or lateral heel pads is about 1.5 mm±0.5 mm. The attachment of the medial and lateral heel pads and the midfoot pads can be accomplished through a hook and loop attachment mechanism so that these cushion pads can be customized by the user for particularized purposes, including affixing, removing, and replacing cushion pads by the user. The angles of inclination of the stability cradle on the medial side are greater than the angles of inclination of the stability cradle on lateral side of the insole. Air vent holes are located in the forefoot pad, and these vent holes extend through the forefoot pad and the base layer to enhance air flow.

The forefoot pad and the base layer can be made of a blown EVA or other material, and the heel cushion can be made of a clear TPR, soft polyurethane or blown EVA. Alternatively, the forefoot pad can be made of clear TPR gel (thermoplastic rubber), where said TPR gel has a hardness rating of 10-20 Asker±3. Alternatively, the forefoot pad can be made of molded pre-blown ethylene vinyl acetate (EVA), polyurethane (PU), or thermoplastic rubber (TPR) or other suitable material, so that it extends from the toe end of the insole to the midfoot area and from the medial side to the lateral side of the forefoot area with a hardness of approximately 10-30 Asker C±3. If the forefoot pad has a patterned surface, the pattern spacing is about 1 mm, groove depth of approximately 1 mm, and a thickness of the forefoot pad of about 1.5 mm±0.5 mm. The forefoot pad can also be molded into the base layer of the insole with or without a knitted fabric layer secured between the forefoot pad and the base layer.

The stability cradle is a semi-rigid material, and the medial heel pad, lateral heel pad and midfoot pad can be made of clear TPR, soft polyurethane or blown EVA. There is a supersoft metatarsal raised dome on the top (foot contact) surface of the insole which would be directly above the metatarsal midfoot area.

The insole has a top sheet layer that extends from heel to toe over the top surface of the base layer. The top sheet of polyester covers the entire foot contact surface of the insole which is treated with an antimicrobial agent. The top sheet can be made of 65% Nylon/35% polyester.

A soft metatarsal dome is located on the top (foot contact) midfoot surface of the insole which would normally be located below the foot metatarsal bones. The metatarsal dome on the top side is integrally formed as an upwardly-curved indentation from bottom surface. There is a metatarsal dome raised above the top surface of the insole, which improves the cushioning characteristics of the insole at or near high impact points on the insole.

In accordance with principles of the present invention, a cushioning core or base is combined with a relatively stiff support cushion and a number of other pads to form an insole that provides greater cushioning, stability, and control than was conventionally known in the state of the art. The pads can have a different firmness than the base or the support cushion. The pads and support cushion assist with prevention of supination, and the supplemental heel pad assists with the prevention of pronation. The current invention is an insole that provides a balanced approach to improving longitudinal arch support, prevention of pronation and prevention of supination by incorporation of the combination of the above elements.

The characteristics of the components, their size and shape, and their position are selected to provide a desired blend of improved cushioning and control, and more specifically to achieve a desired biomechanical function. The size and compression characteristics of the pads can be adjusted to address issues of over/under pronation, over/under supination, and other problems related to foot motion, including altering the size, shape, and material properties of the pads. The firmness of the pads and support cushion can be adjusted to address issues of over/under pronation, over/ under supination, and other problems related to foot motion by altering the size, shape, and material properties of the pads.

The above features appear to be novel characteristics for this insole, and are patentably distinct from the other insoles. The method of construction of the present insole is also a unique and novel feature of the present invention. The present invention accomplishes the goals to: (1) improve ankle and foot stability, (2) cushion the heel and forefoot during push-offs and landings, (3) help prevent over pronation and over supination conditions, and (4) provide enhanced cushioning features to the heel, midfoot, arch and forefoot areas. In a preferred embodiment of the present invention, the components of an insole are permanently affixed to each other to create an insole designed for an intended type or category of activity. Many different insole designs can be made to address a broad range of different activities.

BRIEF DESCRIPTION OF THE DRAWINGS

The above, and other objects and advantages of the present invention will be understood upon consideration of the following detailed description taken in conjunction with the accompanying drawings, in which like reference characters refer to like parts throughout, and in which.

DETAILED DESCRIPTION

Figure 1A:
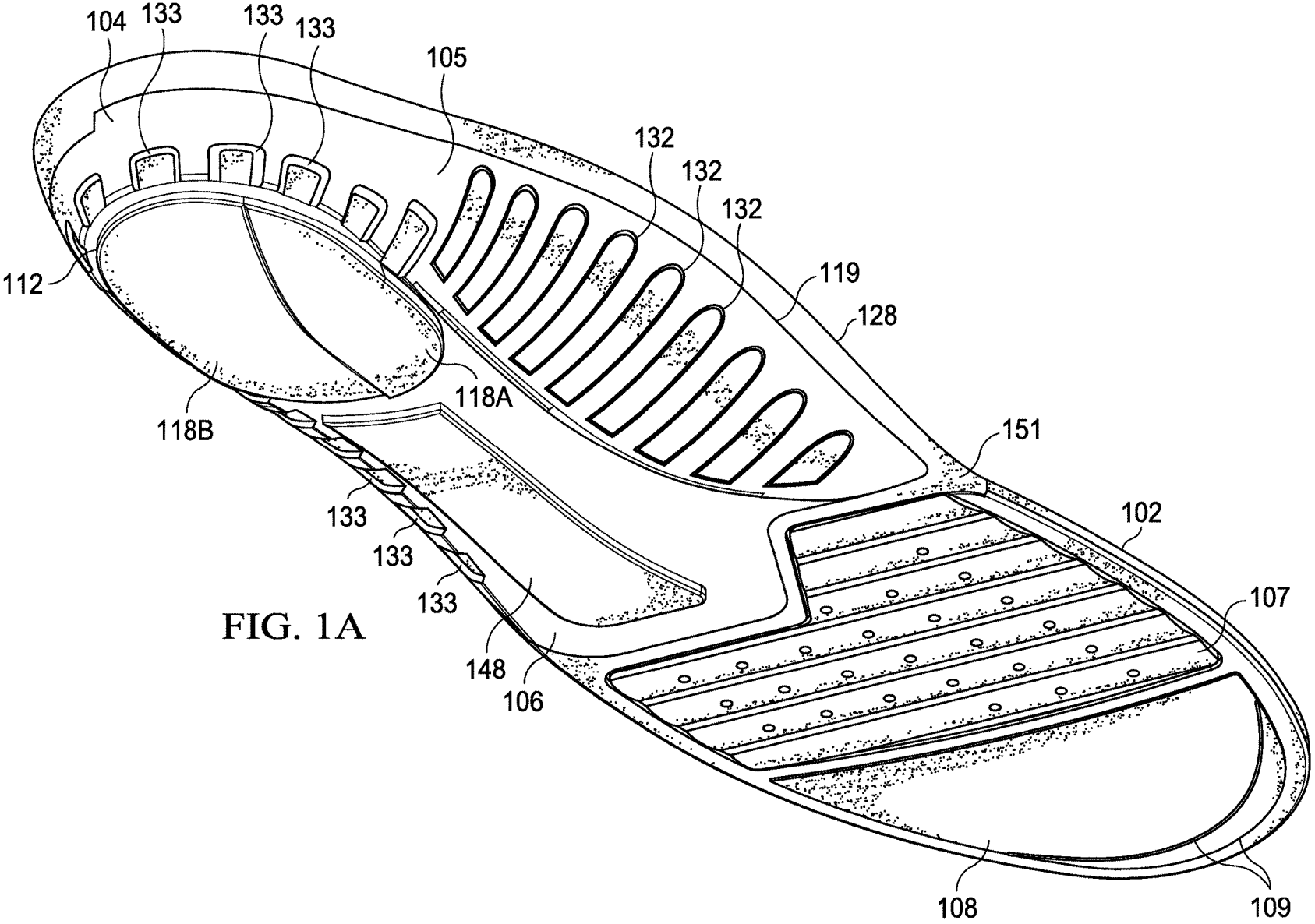
FIG. 1A is a bottom perspective view of an illustrative embodiment of a full insole in accordance with the principles of the present invention.
Figure 1B:
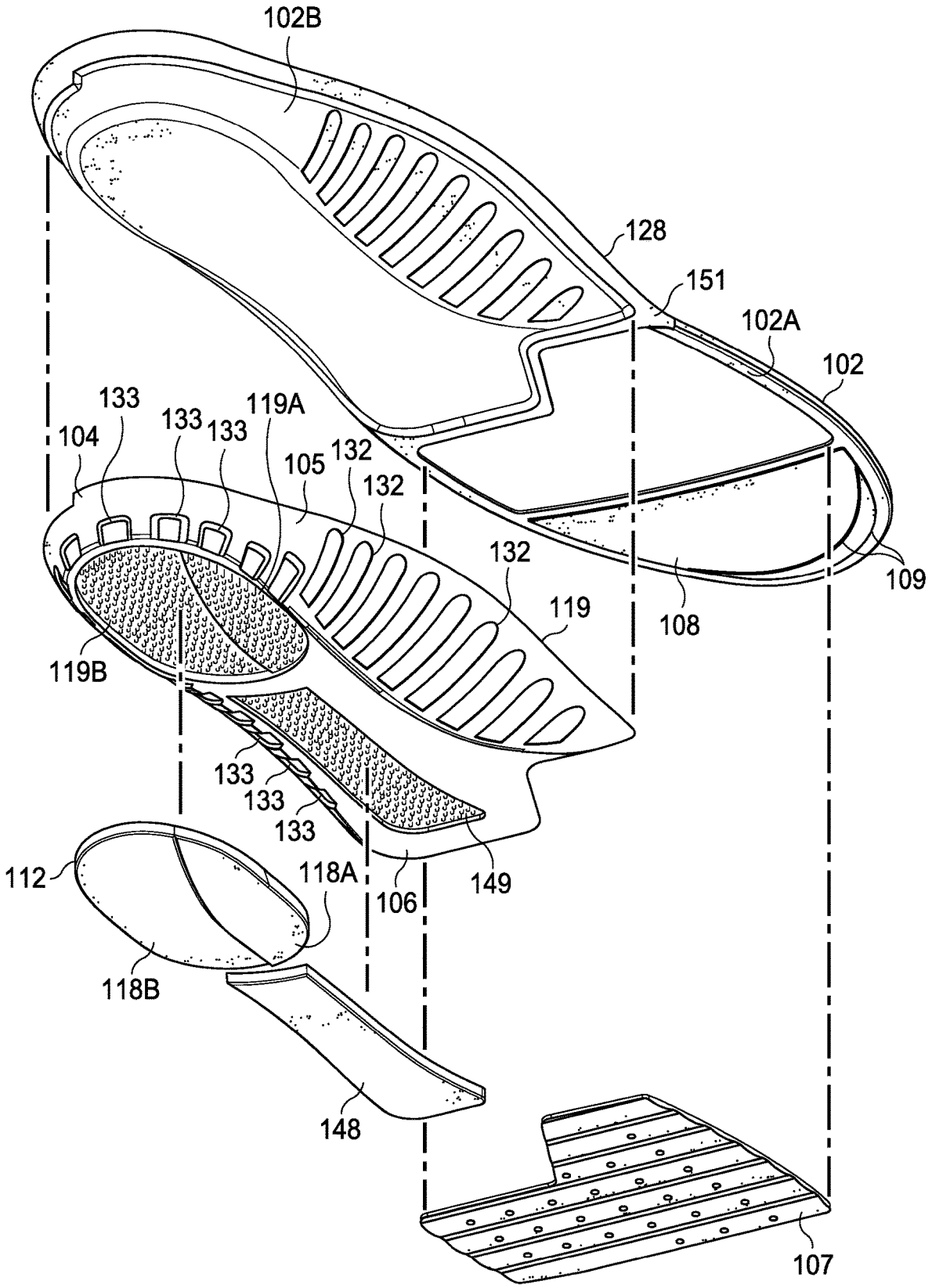
FIG. 1B is a exploded perspective view of an illustrative embodiment of a full insole in accordance with the principles of the present invention.
Figure 2:
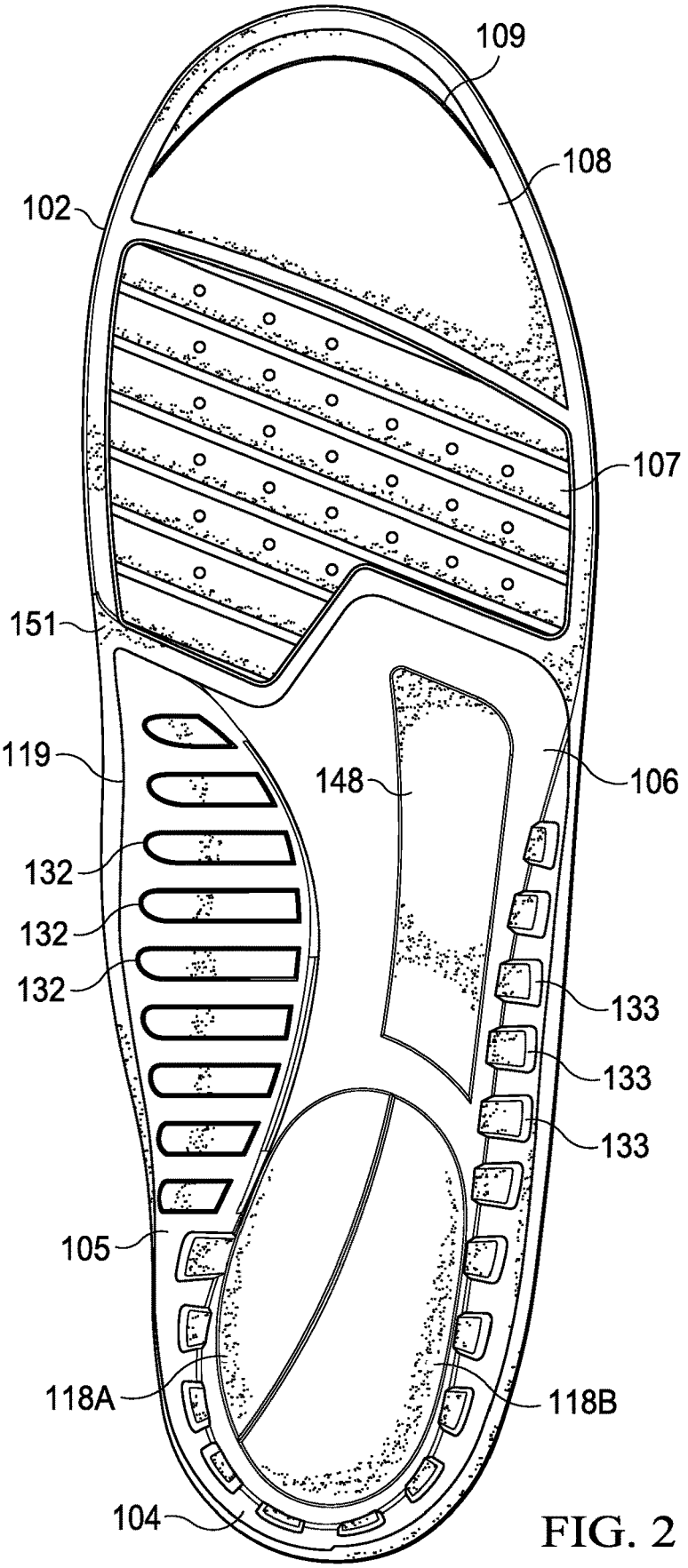
FIG. 2 is a bottom planar view showing the base of the full insole.

Referring to FIGS. 1A, 1B, and 2, these views are perspective and bottom views of the bottom surface (shoe side) of an insole 108 according to the invention. The insole 108 is generally foot-shaped extending longitudinally along an axis from the toe end to the heel end and from the medial side to the lateral side of the insole. More specifically, the insole 108 extends from a heel end (proximal) to a toe end (distal) and has a medial border or side on the arch side of the foot, connecting said toe end to said heel end along the arch side of the insole and a lateral border or side on the other side (opposite side from medial side) thereof, connecting said toe end to said heel end on the other side of the insole.

The insole 108 includes a system of interacting components that cooperate to achieve a desired combination of foot cushioning, support and motion control. The components include a base layer 102, a semi-rigid stability cradle 105, and a number of elastomeric pods 119A, 119B and 149 and pads 118A, 118B and 148. The characteristics of the components, their size and shape, and their position are selected to provide a desired blend of cushioning and control, and more specifically to achieve a desired biomechanical function. In accordance with principles of the present invention, a base layer 102 is combined with a relatively stiff stability cradle 105 and a number of elastomeric pads 118A, 118B and 148 to form an insole that provides cushioning, stability, and control. By altering the size, shape, and material properties of the pods insoles may be designed to address issues of over/under pronation, over/under supination, and other problems related to foot motion.

In a preferred embodiment of the present invention, the components of an insole are permanently affixed to each other to create an insole designed for an intended type or category of activity. Many insole designs may then be made available to address a broad range of different activities. In an alternative embodiment of the invention, an insole may comprise a kit including a number of interchangeable pads 118A, 118B and 148 having different characteristics. Using such a kit, an end user may selectively change the pads to customize the insole to accommodate a specific activities of the user.

The present invention is an insole having a top sheet 128, a toe pad 109 with sizing stripes, a base layer 102 with a stability cradle indentation 102B and a forefoot pad indentation 102A, forefoot pad 107 with diagonally-aligned ridges, a stability cradle 105 with a heel pod opening 119A, 119B, a midfoot pod opening 149, a first set of elongated, transverse ribs 132 in a raised medial arch 119, a second set of vertical support ribs 133 surrounding a heel cup 104, and a third set of vertical support ribs 133 aligned in a lateral midfoot area. The heel pod opening 119A, 119B is configured to have two or more heel adjacent, contiguous pads (medial heel pad 118A and lateral heel pad 118B) removably attached to the stability cradle in the heel pod opening 119A, 119B, and the midfoot pod opening 149 is configured to have at least one midfoot pad 148 removably attached to the stability cradle 105 in the midfoot pod opening 149.

The combination of the base layer 102, stability cradle 105, and a heel/midfoot pads 118A, 118B and 148 specified herein provides a "degree" of medial longitudinal arch support, which provides a couple of degrees of improved pronation "control." A "degree" of medial longitudinal arch support is approximately 1-2 degrees based on research evidence. By pronation "control," we mean the increase in supination moments acting around the joints of the rearfoot and the decrease in the magnitude of pronation moments. The current invention is an insole 100 that provides a balanced approach to improving longitudinal arch support, prevention of pronation and prevention of supination.

The insole 100 also has a forefoot area that correlates with the metatarsal area and near the phalanges of the foot located over the forefoot pad 107 of the insole 100, a raised arch support 119 along the medial arch side, a heel area just forward of the heel cup 104, and a midfoot area 106 between the heel area and forefoot area. A user's right shoe and left shoe are mirror images of one another as are the insoles adapted to be inserted in a right shoe and a left shoe respectively. Only the left insole is illustrated in the Figures. It will be understood by those of skill in the art that the right insole has a mirror image construction of the left insole.

A thin layer of nylon fabric may also be positioned in the forefoot pad indentation 102B between the forefoot pad and the material of the base bottom surface to increase the adhesion of the forefoot pad 107 to the base layer 102 material when the forefoot pad 107 and base layer 102 bottom surface are made of differing materials. Or, a thin fabric can also be positioned in a similar manner between the support cushion 105 and the base layer 102 in the support cushion indentation 102A.

There is a separation wall 151 located between the forefoot indentation 102A and the stability cradle indentation 102B. The raised separation wall 151 is located on the base layer 102 between the forefoot pad 107 and the midfoot support cushion 105, which is located laterally across the width of the insole between the metatarsal and forefoot areas on the insole.

The lateral heel pad 118B and/or medial heel pad 118A is located on the bottom surface of the insole 108. The medial heel pad 118B and/or lateral heel pad 118A, or the midfoot pad 148, on the bottom surface of the insole 108 can be made of clear TPR (thermoplastic rubber) or pre-blown ethylene vinyl acetate (EVA), molded of EVA, polyurethane (PU), or other suitable material with a hardness of approximately 10-35 Asker C±3, a thickness of approximately 3.0 mm±0.5 mm, or alternatively, integrally formed in the material of the base bottom surface of the insole. The thickness of the medial heel pad 118A or lateral heel pad 118B is about 1.5 mm±0.5 mm.

The attachment of the medial heel pad 118A and lateral heel pad 118B and the midfoot pad 148 can be accomplished through a hook and loop attachment mechanism shown on the bottom surface of the openings, 119A, 119B or 149, respectively. This removable attachment allows these cushion pads to be interchanged, selected and customized by the user for particularized purposes, including affixing, removing, and replacing cushion pads by the user. Air vent holes are located in the forefoot pad 107, and these vent holes extend through the forefoot pad 107 and the base layer 102 to enhance air flow.

Forefoot pad 107 is shaped essentially the same as forefoot pad indentation area 102A and is secured therein. Forefoot pad 107 has a medial edge, a lateral edge, a proximal (back) edge and a distal (front) edge. The medial edge of forefoot pad 107 extends along a line spaced laterally from said medial border of said insole. The proximal edge extends from said medial edge laterally and proximally to said rear apex, laterally and distally towards the $3^{rd}$ metatarsal head, then laterally and proximally to the lateral edge approximately along the $3^{rd}$ through $5^{th}$ metatarsal heads.

The forefoot pad 107 generally extends from the proximal region of the metatarsal head area to the distal toe end of the insole and extends from the medial side to the lateral side of the insole. In one embodiment, the forefoot pad is secured within a forefoot pad 107 indentation 102A. The forefoot pad 107 has a thickness of approximately 1.5 mm±0.5 mm. In another embodiment, the forefoot pad 107 is integrally formed in the material of the base layer 102 of the insole 100. The forefoot pad 107 is preferably molded of pre-blown ethylene vinyl acetate (EVA). The forefoot pad 107 may also be molded of EVA, polyurethane (PU), or thermoplastic rubber (TPR) or other suitable material.

The forefoot pad 107 and the base layer 102 can be made of a blown EVA or other material, and the heel cushion can be made of a clear TPR, soft polyurethane or blown EVA. Alternatively, the forefoot pad 107 can be made of clear TPR gel (thermoplastic rubber), where said TPR gel has a hardness rating of 10-20 Asker±3. Alternatively, the forefoot pad 107 can be made of molded pre-blown ethylene vinyl acetate (EVA), polyurethane (PU), or thermoplastic rubber (TPR) or other suitable material, so that it extends from the toe end 109 of the insole 108 to the midfoot area and from the medial side to the lateral side of the forefoot area with a hardness of approximately 10-30 Asker C±3. If the forefoot pad 107 has a patterned surface, the pattern spacing is about 1 mm, groove depth of approximately 1 mm, and a thickness of the forefoot pad of about 1.5 mm±0.5 mm. The forefoot pad 107 can also be molded into the base layer 102 of the insole 108 with or without a knitted fabric layer secured between the forefoot pad 107 and the base layer 102. The stability cradle 105 is a semi-rigid material, and the medial heel pad 118A, lateral heel pad 118B and midfoot pad 148 can be made of clear TPR, soft polyurethane or blown EVA.

In accordance with principles of the present invention, the base layer 102 is combined with a relatively stiff support stability cradle 105 and a number of other pads 118A, 118B, and 148 to form an insole that provides greater cushioning, stability, and control than was conventionally known in the state of the art. The midfoot pad opening 149 is located on the medial midfoot flattened area 106 on the stability cradle 105, and a heel cup 104 surrounds the exterior back of the heel area. The pads 118A, 118B, and 148 can have a different firmness than the base layer 102 or the stability cradle 105. These components assist with prevention of supination, and the supplemental heel pad assists with the prevention of pronation, and all these components provide a balanced approach to improving longitudinal arch support, prevention of pronation and prevention of supination by incorporation of the combination of the above elements.

The present invention is an insole that fits within the interior of a user's shoe, and rests on the interior bottom surface of that shoe with the user's foot being positioned over and on top of the insole. The insole 108 shown in FIGS. 1A-1C and 2A-2B has a bottom (shoe side) and a top (foot side) and the insole 100 comprises a base layer 102 having a contoured shape which receives and supports the foot of the user. The insole 108 is intended to be used inside a shoe and the bottom side thereof will contact the interior of a shoe after insertion therein. In many cases, the insole 108 will be used to replace an insole that previously was used in the shoe.

The base layer 102 has a heel end, a toe end, a lateral side and a medial side, said sides extending approximately from said heel end to said toe end. The lateral side lies adjacent the outer side of a user's foot in use and the medial side lies adjacent the inner side, or arch, of a user's foot in use, including the arch of the foot. The contoured shape includes an integrally formed raised arch support 119 that extends generally upwardly on the medial side of the insole 100. This upward extension arch support 119 allows the raised arch support to lie adjacent to a user's foot arch during use in the shoe.

As an example, approximate dimensions are given for a men's size 9 insole. Length and width of the insole are 28.1 cm (11.063 inches) and 9.7 cm (3.813 inches). The length and width will vary according to the shoe size for which the insole is intended. The total thickness of the insole can range from 6.8 millimeters near the toe area to 12 millimeters in the arch area. Arch height is about 15 millimeters. The forefoot and heel cushions have a thickness of approximately 4.0 millimeters. The preferred depth of the heel cup which is measured from the top side of the insole near the center of the heel area vertically to the top of the upraised heel area or heel raised edge is approximately 15-16 millimeters.

The base layer 102 has a base top surface and a base bottom surface. The base layer 102 defines a heel cup 104 adjacent said heel end, a contoured arch support 119 adjacent to the arch on the medial side, a midfoot area 106 between said arch support 119 and the lateral midfoot area, and a forefoot area located between the metatarsal area to the toe end of the insole 100. There is a metatarsal dome 134 raised on the top surface of insole 100 (shown in FIGS. 3 and 6), which improves the cushioning characteristics of the insole at or near high impact points on the insole 100.

The characteristics of the components, their size and shape, and their position are selected to provide a desired blend of improved cushioning and control, and more specifically to achieve a desired biomechanical function. The size and compression characteristics of the pads can be adjusted to address issues of over/under pronation, over/under supination, and other problems related to foot motion, including altering the size, shape, and material properties of the pads. The firmness of the pads and support cushion can be adjusted to address issues of over/under pronation, over/under supination, and other problems related to foot motion by altering the size, shape, and material properties of the pads.

The base layer 102 is covered by a top sheet 128 that extends across the top surface of the base layer 102 from heel to toe end, and creates a top surface of the insole 100. The top sheet 128 is made of polyester or jadeite covering the entire foot contact surface of the insole, and is treated with an antimicrobial agent. Top sheet 128 is typically made of a non-woven fabric layer with a low coefficient of friction so as to minimize the possibility of blisters, or preferably, top sheet 128 is made of a cooling fabric which contains a special low temperature jade obtained from a natural source.

The top sheet 128 bottom surface is secured to base layer 102 top surface and a top sheet 128 upper surface which contacts the foot of a user during use. The top sheet 128 is oriented to engage the user's foot on the top surface of the insole, and it serves an upper cooling and ventilation function, and the top sheet 128 can be made of suitable materials, such as a jadeite top cloth material. Preferably, the top sheet 128 is made of a low-friction fabric which prevents blisters on the user's foot. The top sheet 128 may also contain an antimicrobial treatment in order to keep bacteria from multiplying and therefore reduce odor. A suitable treatment is Silpure® antimicrobial treatment (Thomson Research Associates, Inc., Ontario, CA.).

Insole 108 production can be accomplished by an open-pour molding process. The process consists of pouring mixed polyurethane or TPR into an open mold. Once poured in the mold, the polyurethane mixture will expand to fill the cavity. Once cured, the base insole is removed from the mold. The forefoot cushion and heel cushion if employed can be secured to the indentations by adhesive or can be secured in place during the polyethylene pouring operation. Bonding occurs to a fabric that is bonded to the forefoot cushion or the heel cushion.

Alternatively, the forefoot pad 107 can be molded onto the bottom surface of the insole base layer 102 from the forefoot pad indentation 102B up to the separation wall 151 on the base bottom surface of the base layer 102. A fabric layer may be inserted between the forefoot pad 107 and the base layer 102 in the forefoot pad indention 102B. And, the midfoot/heel cushion 105 can be molded onto the bottom surface of the insole base layer 102 from the support cushion indentation 102A up to the separation wall 151 on the base bottom surface of the base layer 102. A fabric layer may be inserted between the midfoot-to-heel support cushion 105 and the base layer 102 in the indentation 102A. Also, the heel pad 118 can be molded onto the bottom surface of insole base layer 102 in the heel pod opening 112.

A fabric layer may be inserted between the heel pad 118 and the base layer 102 in the support cushion indentation area 102B. The forefoot pad 107, the heel pad 118, and the midfoot/heel support cushion 105 can also be secured adjacent to one another on the bottom surface of the base layer 102 with an adhesive that is suitable for creating a semi-permanent (or permanent) bond or adhesive, which may be liquid upon application but firms into a solid.

Figure 3:
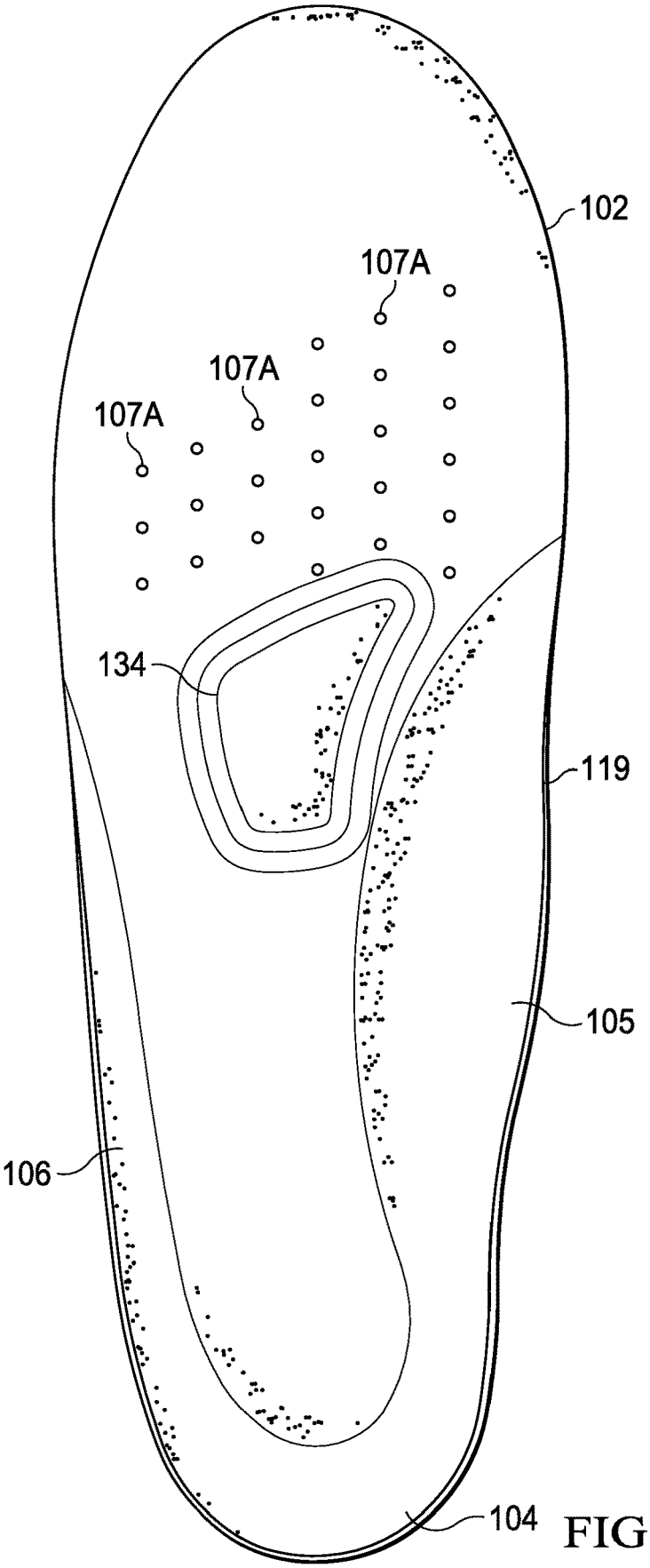
FIG. 3 is a top (dorsal) views of the full insole.

FIG. 3 illustrates the top (foot side) of an insole 100 according to the invention with a top sheet 128 covering the top side of the insole 100, which is placed over the base layer 102. A metatarsal dome 134 raised on the top surface of insole 100, each of which respectively improves the cushioning characteristics of the insole at or near high impact points on the insole 100. The medial side of the base layer 102, the heel cup 104, and the lateral side 106 of the base layer 102 are shown in FIG. 3. The teardrop metatarsal pad 134 on top side is integrally formed as upwardly-curved indentation from bottom surface of the insole. Air vent holes 107A are shown extending through the top sheet 128.

On the foot contact surface of the insole 100, the base layer 102 has a raised metatarsal dome 134. The metatarsal dome 134 is positioned under the heel bone to provide additional cushioning to the user's heel while walking or standing. The metatarsal dome 134 curves upward from the insole 100 top (foot contact) surface to make a dome-like contact surface under the metatarsal area of the foot. The metatarsal dome 134 is preferably molded as a cushion separate from the base layer 102 and is secured to the top side of the base layer 102. The metatarsal dome 134 is covered by the top sheet 128 providing a continuous contact surface to the user's foot on the top (foot contact) surface of the insole. In an alternative embodiment, the metatarsal dome 134 is integrally formed in the material comprising the top side of the base layer 102.

The metatarsal dome 134 is preferably formed of super soft low density polyurethane, but may be formed of polyurethane memory foam, ethylene glycol polyurethane, ethylene vinyl acetate (EVA), pre-blown EVA, polyurethane (PU), thermoplastic rubber (TPR) or other suitable material. Hardness of the metatarsal dome 134 material can range from less than 10 Asker±3 to greater than 30 Asker±3.

A soft metatarsal dome 134 is located on the top (foot contact) surface providing cushioning directly over the metatarsal area of the foot. The top sheet 128 is shown in FIG. 1B, and the exposed top view of the insole 100 is shown in FIG. 3 without the top sheet 128. The top sheet 128 covers the entire foot contact surface of the insole 100 which is treated with an antimicrobial agent. The top surface of the insole 100 is covered by a top sheet 128 that extends across the top surface from heel to toe end. Top sheet 128 is typically made of a non-woven fabric layer with a low coefficient of friction so as to minimize the possibility of blisters, or preferably, top sheet 128 is made of a cooling fabric which contains a special low temperature jade obtained from a natural source. The top sheet can be made of 65% Nylon/35% polyester.

Figure 4:
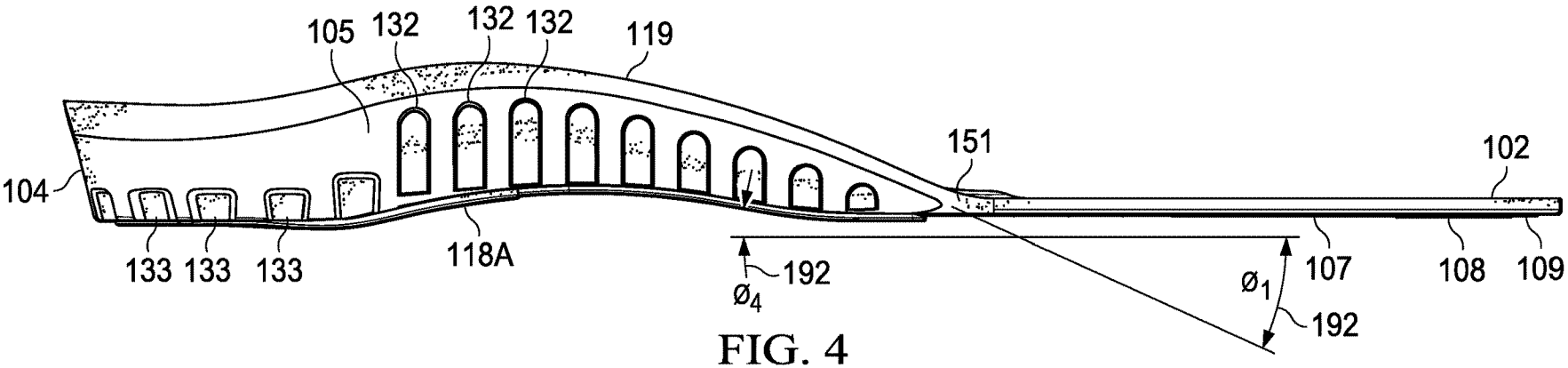
FIG. 4 is a medial (inner arch area) side view of the full insole.
Figure 5:
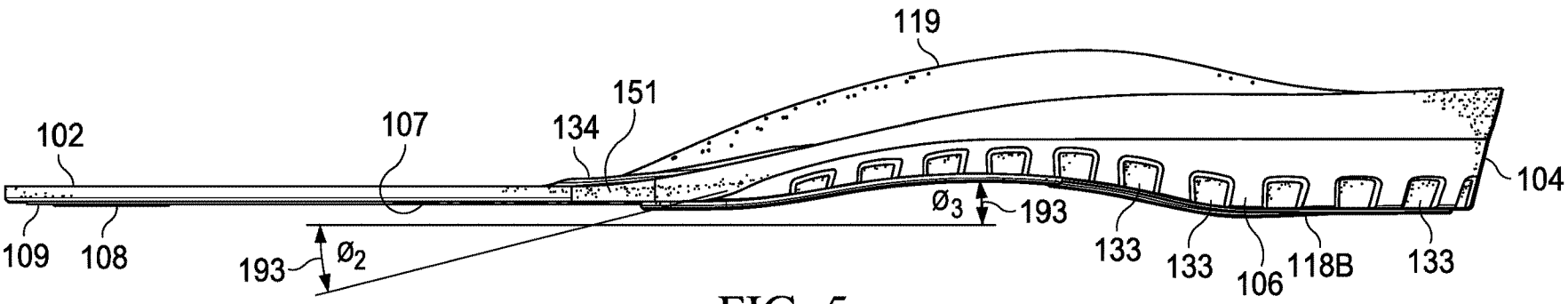
FIG. 5 is a lateral (outer) side view of the full insole.

Referring to FIGS. 4 and 5, the medial and lateral side views of the insole 108 are shown with a toe pad 109 with sizing stripes, a base layer 102, forefoot pad 107 with diagonally-aligned ridges, a stability cradle 105 with a heel cup 104 and a medial side 106, a separation wall 151, a medial heel pad 118A, a lateral heel pad 118B, a first set of elongated, transverse ribs 132 in a raised medial arch 119, a second set of vertical support ribs 133 surrounding a heel cup 104, and a third set of vertical support ribs 133 aligned in a lateral midfoot area 106. The vertical support ribs 133 and the elongated, transverse ribs 132 provide enhanced cushioning during impact, and allow greater compression for those conditions than has been previously attainable.

A soft metatarsal dome 134 is located on the top (foot contact) midfoot surface of the insole 108 which would normally be located below the foot metatarsal bones. The metatarsal dome 134 on the top side is integrally formed as an upwardly-curved indentation from bottom surface. There is a metatarsal dome 134 raised above the top surface of the insole, which improves the cushioning characteristics of the insole at or near high impact points on the insole 108.

The metatarsal raised dome (shown on FIGS. 3, 5 and 6) on the top (foot contact) surface of the insole which would be directly above the metatarsal midfoot area. The insole 108 has a top sheet 128 extends from heel to toe over the top surface of the base layer 102. The top sheet 128 of polyester covers the entire foot contact surface of the insole which is treated with an antimicrobial agent. The top sheet 128 can be made of 65% Nylon/35% polyester.

The angles of inclination $\phi_1$ 192 is the angle provided between the side edge of the medial arch 119 and the horizontal, and that angle is preferably 32 degrees and could range from 21 degrees to 44 degrees. The angles of inclination $\phi_2$ 193 is the angle provided between the side edge of the lateral side of the stability cradle 106 and the horizontal, and that angle is preferably 16 degrees and could range from 11 degrees to 21 degrees.

Figure 6:
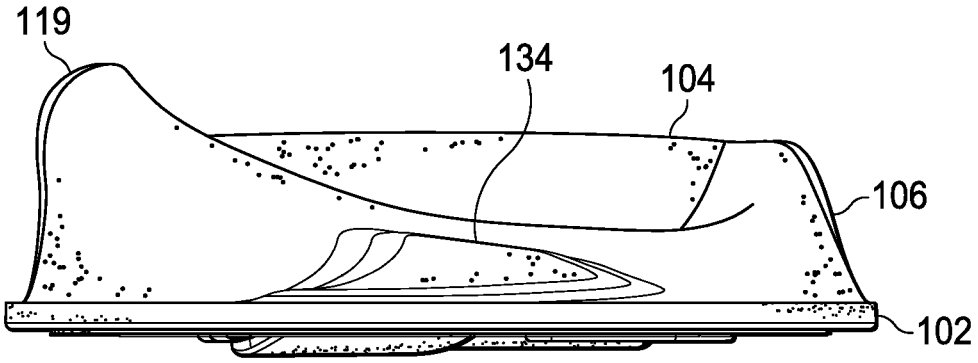
FIG. 6 is a front (proximal) view of the full insole.
Figure 7:
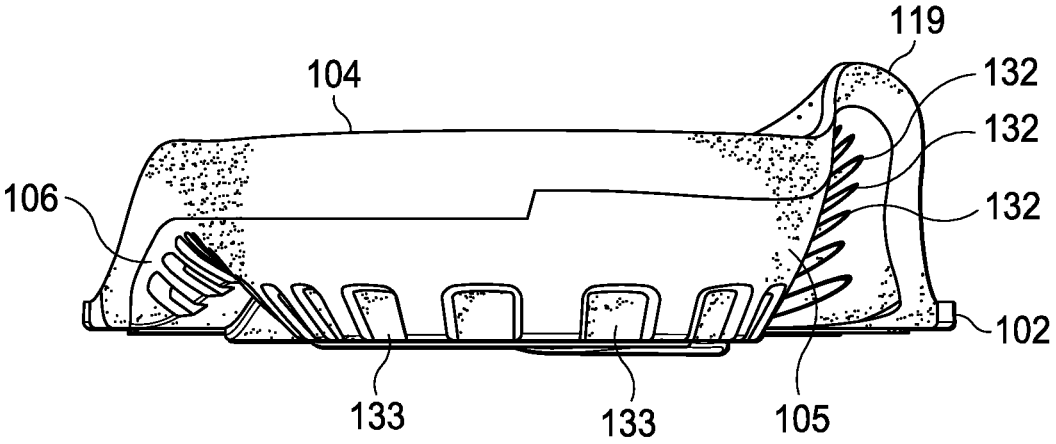
FIG. 7 is a rear (proximal) view of the full insole.

Now referring to FIG. 6, the front end view of the insole 108 from the toe end looking toward the heel cup 104, upraised heel area is visible at the heel end 104, raised arch support 119 is seen on the medial side, the base layer 102 and lateral side 106. FIG. 7 shows the heel end view of the insole 108 looking from the heel cup 104 towards the toe area, with a lateral side 106, raised medial arch 119 on the base layer 102 and the elongated, transverse ribs 132 and vertical support ribs 133 on the stability cradle 105.

Figure 8:
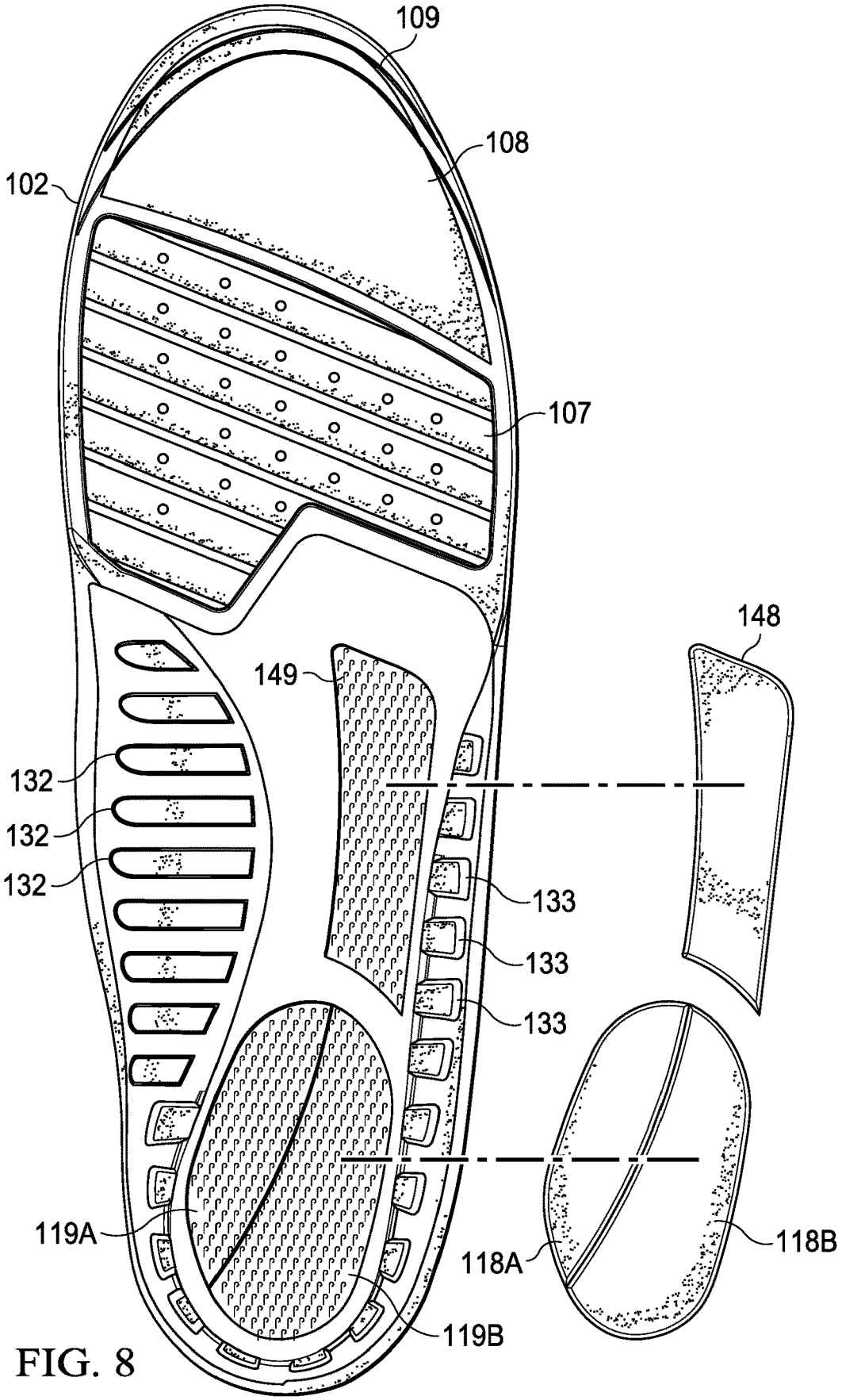
FIG. 8 is a bottom planar view of the full insole with the medial heel pad, lateral heel pad and midfoot pad detached.

As shown in FIG. 8, the present invention is an insole having a top sheet 128, a toe pad 109 with sizing stripes, a base layer 102, forefoot pad 107 with diagonally-aligned ridges and air vent holes, a stability cradle 105 with a heel pod opening 119A, 119B, a midfoot pod opening 149, a first set of elongated, transverse ribs 132 in a raised medial arch 119, a second set of vertical support ribs 133 surrounding a heel cup 104, and a third set of vertical support ribs 133 aligned in a lateral midfoot area. The heel pod opening 119A, 119B is configured to have two or more heel adjacent, contiguous pads (medial heel pad 118A and lateral heel pad 118B) removably attached to the stability cradle in the heel pod opening 119A, 119B, and the midfoot pod opening 149 is configured to have at least one midfoot pad 148 removably attached to the stability cradle 105 in the midfoot pod opening 149.

Figure 9:
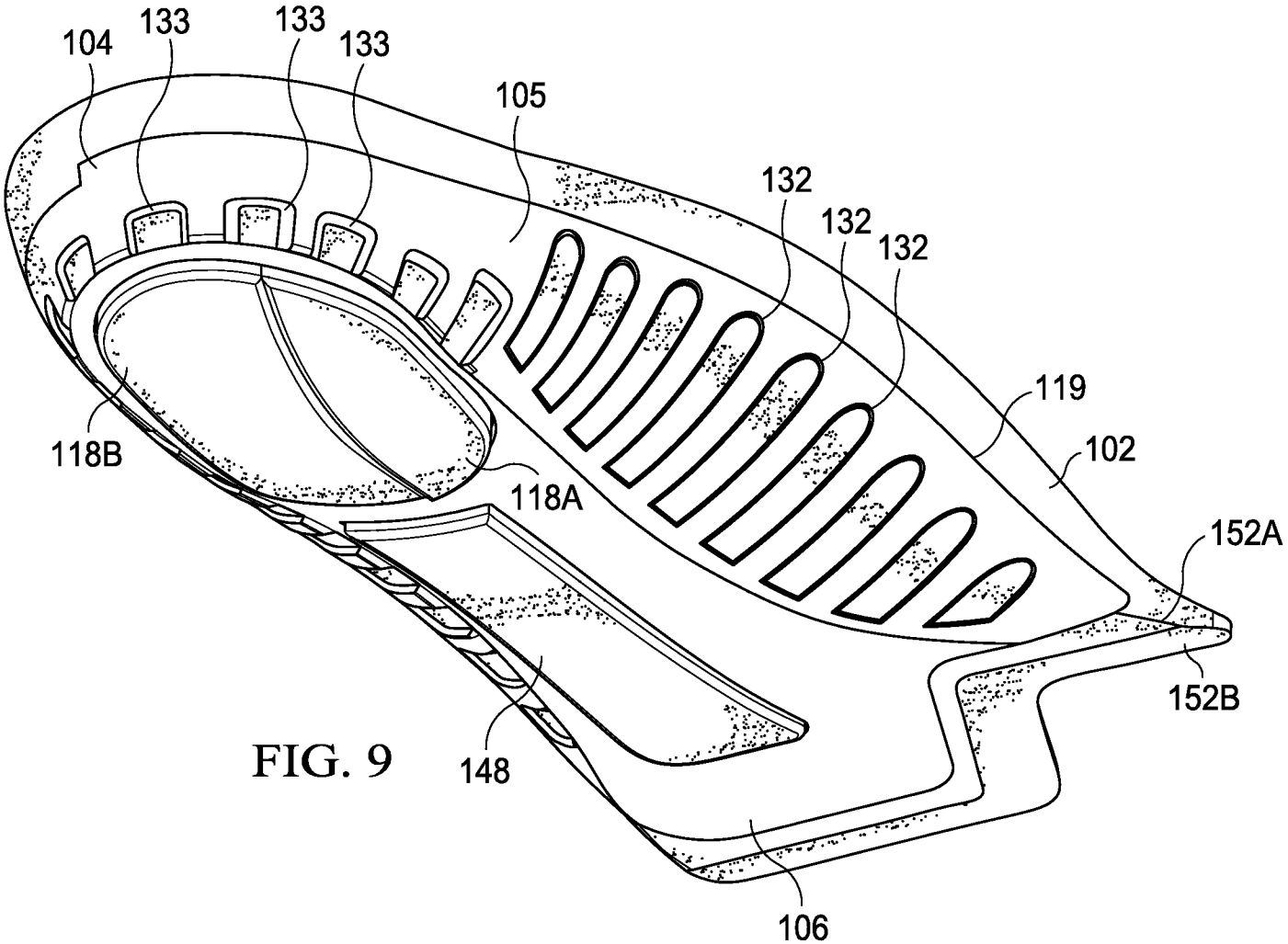
FIG. 9 is a bottom perspective view of an illustrative embodiment of a half insole in accordance with the principles of the present invention.
Figure 10:
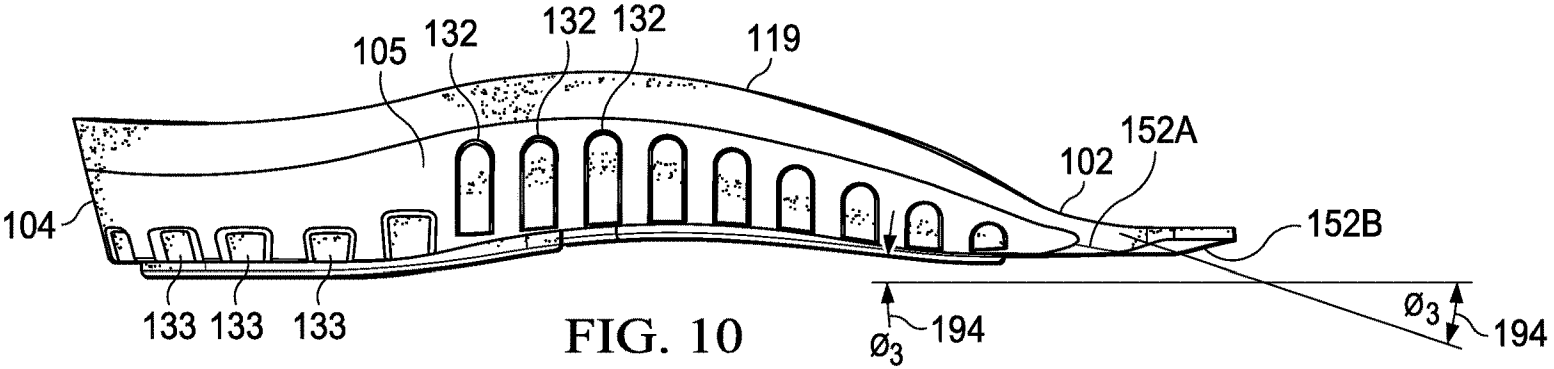
FIG. 10 is a medial (inner arch area) side view of the half insole.
Figure 11:
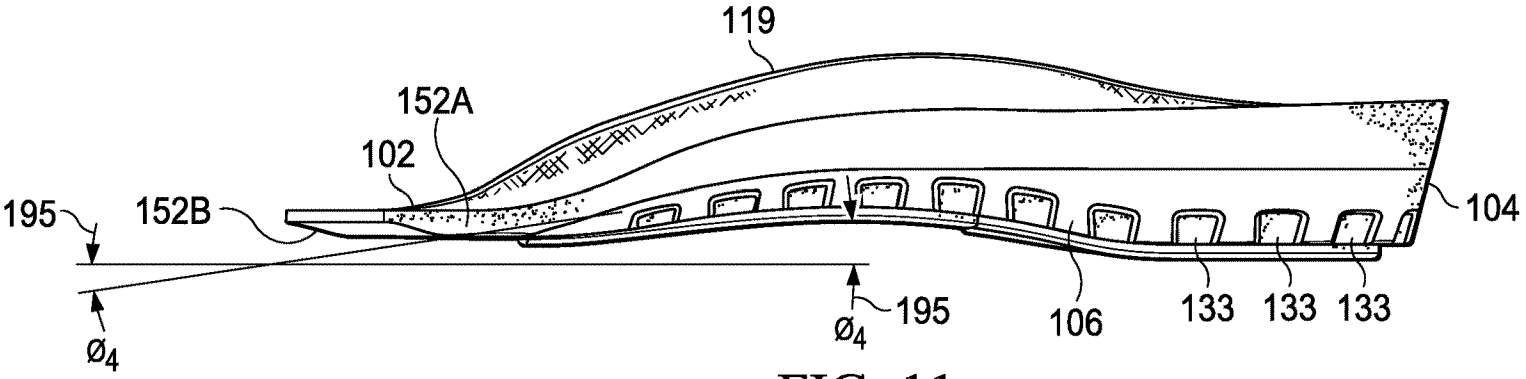
FIG. 11 is a lateral (outer) side view of the half insole.

A half body insole design is shown in FIG. 9-11 a base layer 102, a stability cradle 105 with a heel pod opening 119A, 119B, a midfoot pod opening 149, a first set of elongated, transverse ribs 132 in a raised medial arch 119, a second set of vertical support ribs 133 surrounding a heel cup 104, and a third set of vertical support ribs 133 aligned in a lateral midfoot area. The heel pod opening 119A, 119B is configured to have two or more heel adjacent, contiguous pads (medial heel pad 118A and lateral heel pad 118B) removably attached to the stability cradle in the heel pod opening 119A, 119B, and the midfoot pod opening 149 is configured to have at least one midfoot pad 148 removably attached to the stability cradle 105 in the midfoot pod opening 149.

As shown in FIGS. 10 and 11, the medial and lateral side views of the half insole are shown with a base layer 102, a stability cradle 105 with a heel cup 104 and a medial side 106, a separation wall 151, a medial heel pad 118A, a lateral heel pad 118B, a first set of elongated, transverse ribs 132 in a raised medial arch 119, a second set of vertical support ribs 133 surrounding a heel cup 104, and a third set of vertical support ribs 133 aligned in a lateral midfoot area 106. The vertical support ribs 133 and the elongated, transverse ribs 132 provide enhanced cushioning during impact, and allow greater compression for those conditions than has been previously attainable.

The angles of inclination $\phi_3$ 194 is the angle provided between the side edge of the medial arch 119 and the horizontal, and that angle is preferably 32 degrees and could range from 21 degrees to 44 degrees. The angles of inclination $\phi_4$ 195 is the angle provided between the side edge of the lateral side of the stability cradle 106 and the horizontal, and that angle is preferably 16 degrees and could range from 11 degrees to 21 degrees.

Foot contact with the ground is generally divided into three phases: heel strike, midfoot support, and toe off. During heel strike, the heel of the foot impacts the ground with significant force. Following the initial impact of the heel with the ground, the foot twists, or pronates, bringing the medial side of the heel into contact with the ground. The foot is sensitive to the amount of pronation as well as the rate at which the pronation occurs. Pronation is natural, and some degree of pronation is desirable because it serves to absorb the stresses and forces on the foot during walking or running. However, an excessive amount or rate of pronation can result in injury.

To cushion the impact the components described above to work in conjunction with each other to accomplish the goals of the invention, such as: (1) improving ankle and foot stability, (2) cushioning the heel and forefoot during push-offs and landings, (3) helping prevent over pronation and over supination conditions, and (4) providing enhanced cushioning features to the heel, midfoot, arch and forefoot areas. Support cushion 105 provides firm support along the medial portion of the foot, including the medial arch area and surrounding the heel area, to help control the amount of foot pronation.

In a first preferred embodiment of the present invention, the various components of an insole which are secured to base layer 102 in the indentation areas defined by base layer 102 on the bottom surface are permanently affixed to base layer 102 using an appropriate means such as an adhesive. The components are secured during the molding process using techniques known in the art of molding insoles. The indentation areas are also lined with a cloth having a base surface and a pad surface, secured to said base layer 102 along said base surface and said pad along said pad surface. Alternatively, a cloth is secured to said pad and then the composite structure secured to the indentation area.

An improved insole 108 has been disclosed. It will be readily apparent that the illustrative embodiments of an insole thus disclosed may be useful in cushioning the foot and controlling pronation during activities such as hiking, backpacking, and the like. However, one will understand that the components of the insole system may be modified to accommodate other activities or to control other kinds of foot motion. Thus, the description provided herein, including the presentation of specific thicknesses, materials, and properties of the insole components, is provided for purposes of illustration only and not of limitation, and that the invention is limited only by the appended claims.

The invention claimed is:

1. A contoured insole used inside a shoe and having a top side that contacts the users foot, a bottom side that contacts the interior of a shoe after insertion therein, a lateral side that lies adjacent to the outer side of a user's foot in use and a medial side that lies adjacent the inner side, or arch, of a user's foot, said insole comprising:

a base layer having a contoured shape which receives and supports the foot of the user, a heel end, a toe end, a top surface, a bottom surface, a lateral side and a medial side, said lateral and medial sides extending approximately from said heel end to said toe end, said base layer having:

(a) a forefoot pad indentation area on the bottom surface of the insole extending from the midfoot to the toe area of the base layer and supporting the insertion of a forefoot pad therein, (b) a stability cradle indentation area on the bottom surface of the insole extending from the midfoot to the heel area of the insole and supporting the insertion of a stability cradle therein;

(c) a metatarsal dome on the top surface of base layer and raised over the metatarsal midfoot area of the insole;

(d) separation wall on the bottom surface of the base layer and located between said forefoot pad indentation area and said mid-foot-to-heel stability cradle indentation area a stability cradle positioned on the bottom surface of the base layer in the stability cradle indentation area and having:

(a) a raised arch support on the bottom surface of the insole in the medial arch area, (b) a heel cup on the bottom surface of the insole and surrounding the heel end of the insole with vertical walls, (c) a first set of elongated, transverse ribs in a raised medial arch, said raised medial arch extending continuously along an inner side of the stability cradle, (d) a second set of vertical support ribs surrounding the heel cup, (e) a third set of vertical support ribs aligned in a lateral midfoot area, said lateral midfoot area extending continuously along an outer side of the stability cradle, (f) a midfoot pad aperture on the bottom surface of the stability cradle in the midfoot area, and (g) a heel pad aperture on the bottom surface of the stability cradle in the heel area, a forefoot pad positioned on the bottom surface of the insole in the forefoot indentation area;

a medial heel pad positioned on the medial side of the heel pad aperture in the stability cradle;

a lateral heel pad positioned on the medial side of the heel pad aperture in the stability cradle;

a midfoot heel pad positioned in the midfoot pad aperture in the stability cradle; and, a top sheet that extends across the top surface of the base layer from the heel end to the toe end of the insole.

2. The insole of claim 1, wherein said base layer is formed of a gel material.

3. The insole of claim 1, wherein said base layer is made of polyurethane polyester glycol with a hardness 10-30 Asker±3.

4. The insole of claim 1, wherein said forefoot pad made of a clear TPR gel (thermoplastic rubber).

5. The insole of claim 4, wherein said TPR gel has a hardness rating of 10-20 Asker±3.

6. The insole of claim 1, wherein said forefoot pad has a groove pattern with a width spacing of approximately 1.0 mm-1.50 mm.

7. The insole of claim 1, wherein said heel pad is made of pre-blown EVA (ethylene-vinyl acetate) material.

8. The insole of claim 7, wherein said heel pad has a hardness rating of 10-35 Asker±3.

9. The insole of claim 1, wherein said top sheet is made of 65% Nylon/35% polyester.

10. The insole of claim 1, wherein said metatarsal dome on the top side of the insole matches the upwardly-curved metatarsal arch dome on the bottom surface of the insole.

11. The insole of claim 1, wherein said separation wall located on the bottom surface of the base layer and is approximately 1 mm in height.

12. The insole of claim 1, wherein said forefoot and heel pads are made of rubber or synthetic rubber.

13. The insole of claim 1, wherein said forefoot and heel pads are made of a neoprene synthetic rubber.

14. A contoured insole used inside a shoe and having a top side that contacts the users foot, a bottom side that contacts the interior of a shoe after insertion therein, a lateral side that lies adjacent to the outer side of a user's foot in use and a medial side that lies adjacent the inner side, or arch, of a user's foot, said insole comprising:

a base layer having a contoured shape which receives and supports the foot of the user, a heel end, a toe end, a top surface, a bottom surface, a lateral side and a medial side, said lateral and medial sides extending approximately from said heel end to said toe end, said base layer having:

(a) a forefoot pad indentation area on the bottom surface of the insole extending from the midfoot to the toe area of the base layer and supporting the insertion of a forefoot pad therein, (b) a stability cradle indentation area on the bottom surface of the insole extending from the midfoot to the heel area of the insole and supporting the insertion of a stability cradle therein;

(c) a metatarsal dome on the top surface of base layer and raised over the metatarsal midfoot area of the insole;

(d) separation wall on the bottom surface of the base layer and located between said forefoot pad indentation area and said mid-foot-to-heel stability cradle indentation area a stability cradle positioned on the bottom surface of the base layer in the stability cradle indentation area and having:

(a) a raised arch support on the bottom surface of the insole in the medial arch area, (b) a heel cup on the bottom surface of the insole and surrounding the heel end of the insole with vertical walls, (c) a first set of elongated, transverse ribs in a raised medial arch, said raised medial arch extending continuously along an inner side of the stability cradle, (d) a second set of vertical support ribs surrounding the heel cup, (e) a third set of vertical support ribs aligned in a lateral midfoot area, said lateral midfoot area extending continuously along an outer side of the stability cradle, (f) a midfoot pad aperture on the bottom surface of the stability cradle in the midfoot area, and (g) a heel pad aperture on the bottom surface of the stability cradle in the heel area, a forefoot pad positioned on the bottom surface of the insole in the forefoot indentation area;

a medial heel pad positioned on the medial side of the heel pad aperture in the stability cradle;

a lateral heel pad positioned on the medial side of the heel pad aperture in the stability cradle; and, a midfoot heel pad positioned in the midfoot pad aperture in the stability cradle.

15. The insole of claim 14, wherein said base layer has separation wall on the bottom surface of the base layer and located between said forefoot pad indentation area and said mid-foot-to-heel stability cradle indentation area.

16. The insole of claim 14, wherein said separation wall located on the bottom surface of the base layer and is approximately 1 mm in height.

17. The insole of claim 14, wherein said base layer has a metatarsal dome on the top surface of base layer and raised over the metatarsal midfoot area of the insole.

18. The insole of claim 14, wherein base layer is made of a durable nylon fabric.

19. The insole of claim 14, wherein said base layer is formed from a gel material.

20. The insole of claim 14, wherein said base layer is made of polyurethane polyester glycol with a hardness 30 Asker±3.

21. The insole of claim 14, wherein said forefoot pad is made of clear TPR gel (thermoplastic rubber) gel.

22. The insole of claim 21, wherein said TPR gel has a hardness rating of 10-20 Asker±3.

23. The insole of claim 14, wherein said forefoot pad has a groove pattern with a width spacing of approximately 1.0 mm-1.50 mm.

24. The insole of claim 14, wherein said heel pad made of pre-blown EVA (ethylene-vinyl acetate) material.

25. The insole of claim 24, wherein said heel pad has a hardness rating of 10-35 Asker±3.

26. The insole of claim 14, wherein said heel pad has a groove pattern with a width spacing of approximately 1.0 mm-1.50 mm.

27. The insole of claim 14, further comprising a top sheet made of 65% Nylon/35% polyester.

28. The insole of claim 14, wherein said metatarsal dome on the top side of the insole matches the upwardly-curved metatarsal arch dome on the bottom surface of the insole.

29. The insole of claim 14, wherein said forefoot pad and stability cradle are made of rubber or synthetic rubber.

30. The insole of claim 14, wherein said forefoot pad and stability cradle are made of a neoprene synthetic rubber layer which is a polymer.

31. A method of making a contoured insole to be used inside a shoe and having a top side that contacts the users foot, a bottom side that contacts the interior of a shoe after insertion therein, a lateral side that lies adjacent to the outer side of a user's foot in use and a medial side that lies adjacent the inner side, or arch, of a user's foot, said insole comprising:

providing a base layer with a contoured shape which receives and supports the foot of the user, said base layer having a heel end, a toe end, a top surface, a bottom surface, a lateral side and a medial side, said lateral and medial sides extending approximately from said heel end to said toe end, and said base layer having:

(a) a forefoot pad indentation area on the bottom surface of the insole extending from the midfoot to the toe area of the base layer and supporting the insertion of a forefoot pad therein, (b) a stability cradle indentation area on the bottom surface of the insole extending from the midfoot to the heel area of the insole and supporting the insertion of a stability cradle therein;

(c) a metatarsal dome on the top surface of base layer and raised over the metatarsal midfoot area of the insole;

(d) separation wall on the bottom surface of the base layer and located between said forefoot pad indentation area and said mid-foot-to-heel stability cradle indentation area positioning a stability cradle on the bottom surface of the base layer in the stability cradle indentation area, said stability cradle having:

(a) a raised arch support on the bottom surface of the insole in the medial arch area, (b) a heel cup on the bottom surface of the insole and surrounding the heel end of the insole with vertical walls, (c) a first set of elongated, transverse ribs in a raised medial arch, said raised medial arch extending continuously along an inner side of the stability cradle, (d) a second set of vertical support ribs surrounding the heel cup, (e) a third set of vertical support ribs aligned in a lateral midfoot area, said lateral midfoot area extending continuously along an outer side of the stability cradle, (f) a midfoot pad aperture on the bottom surface of the stability cradle in the midfoot area, and (g) a heel pad aperture on the bottom surface of the stability cradle in the heel area, positioning a forefoot pad on the bottom surface of the insole in the forefoot indentation area;

positioning a medial heel pad in the heel pad aperture of the stability cradle, positioning a lateral heel pad in the heel pad aperture of the stability cradle, positioning a midfoot pad in a midfoot pad aperture of the stability cradle, placing a top sheet that extends across the top surface of the base layer from the heel end to the toe end of the insole.

32. The method of making the insole of claim 31, wherein said base layer is formed of a gel material.

33. The method of making the insole of claim 31, wherein said base layer is made of polyurethane polyester glycol with a hardness 10-30 Asker±3.

34. The method of making the insole of claim 31, wherein said forefoot pad made of a clear TPR gel (thermoplastic rubber).

35. The method of making the insole of claim 34, wherein said TPR gel has a hardness rating of 10-20 Asker±3.

36. The method of making the insole of claim 31, wherein said forefoot pad has a groove pattern with a width spacing of approximately 1.0 mm-1.50 mm.

37. The method of making the insole of claim 31, wherein said heel pad is made of pre-blown EVA (ethylene-vinyl acetate) material.

38. The method of making the insole of claim 37, wherein said heel pad has a hardness rating of 10-35 Asker±3.

39. The method of making the insole of claim 31, wherein said heel pad has a groove pattern with a width spacing of approximately 1.0 mm-1.50 mm.

40. The method of making the insole of claim 31, wherein said heel pad aperture is surrounded by heel pad aperture grooves.

41. The method of making the insole of claim 31, wherein base layer is made of a durable nylon fabric.

42. The method of making the insole of claim 31, wherein said top sheet is made of 65% Nylon/35% polyester.

43. The method of making the insole of claim 31, wherein said separation wall located on the bottom surface of the base layer and is approximately 1 mm in height.

44. The method of making the insole of claim 31, wherein said forefoot pad and stability cradle are made of rubber or synthetic rubber.

45. The method of making the insole of claim 31, wherein said forefoot pad and stability cradle are made of a neoprene synthetic rubber.

46. The method of making the insole of claim 31, wherein said steps of positioning include forming the material by molding in place.

* * * * *